US009052631B2

(12) United States Patent
Gohda et al.

(10) Patent No.: US 9,052,631 B2
(45) Date of Patent: Jun. 9, 2015

(54) IMAGE FORMING APPARATUS, PROCESS CARTRIDGE, AND IMAGE FORMING METHOD

(71) Applicants: Shohei Gohda, Kanagawa (JP); Shinji Nohsho, Tokyo (JP); Masanobu Gondoh, Kanagawa (JP); Kaori Toyama, Kanagawa (JP); Yohta Sakon, Kanagawa (JP); Masahiro Ohmori, Kanagawa (JP)

(72) Inventors: Shohei Gohda, Kanagawa (JP); Shinji Nohsho, Tokyo (JP); Masanobu Gondoh, Kanagawa (JP); Kaori Toyama, Kanagawa (JP); Yohta Sakon, Kanagawa (JP); Masahiro Ohmori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/132,444

(22) Filed: Dec. 18, 2013

(65) Prior Publication Data

US 2014/0178103 A1 Jun. 26, 2014

(30) Foreign Application Priority Data

Dec. 26, 2012 (JP) ..... 2012-282844

(51) Int. Cl.
*G03G 21/00* (2006.01)
*G03G 15/02* (2006.01)
*G03G 21/18* (2006.01)

(52) U.S. Cl.
CPC ..... *G03G 15/0233* (2013.01); *G03G 21/0017* (2013.01); *G03G 21/1814* (2013.01)

(58) Field of Classification Search
CPC ..... G03G 21/0011; G03G 21/0017; G03G 2221/0005
USPC ..... 399/176, 350; 15/256.5, 256.51, 15/256.52; 430/125.31, 126.2
See application file for complete search history.

(56) References Cited

U.S. PATENT DOCUMENTS

| | | | | |
|---|---|---|---|---|
| 2007/0140761 | A1 | 6/2007 | Sugimoto | |
| 2007/0212137 | A1 | 9/2007 | Sugimoto | |
| 2008/0187360 | A1* | 8/2008 | Fujita et al. | 399/176 |
| 2009/0311017 | A1 | 12/2009 | Ohmori et al. | 399/350 |
| 2011/0299887 | A1 | 12/2011 | Miyaji et al. | |
| 2012/0063826 | A1 | 3/2012 | Ohmori et al. | 399/350 |
| 2013/0243507 | A1 | 9/2013 | Sakon et al. | |

FOREIGN PATENT DOCUMENTS

| | | | |
|---|---|---|---|
| EP | 1801663 | A2 | 6/2007 |
| EP | 1832940 | A1 | 9/2007 |

(Continued)

OTHER PUBLICATIONS

European Search Report dated Apr. 23, 2014 in corresponding European patent application No. 13 19 9455.0.

*Primary Examiner* — Sophia S Chen
(74) *Attorney, Agent, or Firm* — Cooper & Dunham LLP

(57) ABSTRACT

An image forming apparatus, including: an image bearing member; a charging unit; an exposure unit; a developing unit; a transfer unit; a fixing unit; and a cleaning unit including a cleaning blade, wherein the charging unit includes a charging roller that is brought into contact with the image bearing member for charging, the charging roller abutting the image bearing member at a pressing force of 10 mN/cm to 1,000 mN/cm, wherein the cleaning blade includes an elastic member that abuts the surface of the image bearing member to remove a residue attached to the surface of the image bearing member, and wherein an abutment part of the elastic member, which abuts the surface of the image bearing member, includes a cured product of an ultraviolet curable composition containing a (meth)acrylate compound having an alicyclic structure having 6 or more carbon atoms in a molecule.

10 Claims, 7 Drawing Sheets

(56) References Cited

FOREIGN PATENT DOCUMENTS

| | | | |
|---|---|---|---|
| EP | 2642351 | A2 | 9/2013 |
| JP | 2004-233818 | | 8/2004 |
| JP | 3602898 | | 10/2004 |
| JP | 2005-239929 | | 9/2005 |
| JP | 2010-152295 | | 7/2010 |
| JP | 2012-083729 | | 4/2012 |
| WO | WO 2008/062764 | A1 * | 5/2008 |

* cited by examiner

Peripheral length: C1
Projected area of particle: S

Circle having area S
Peripheral length: C2

IMAGE FORMING APPARATUS, PROCESS CARTRIDGE, AND IMAGE FORMING METHOD

BACKGROUND OF THE INVENTION

1. Field of the Invention

The present invention relates to an image forming apparatus, a process cartridge, and an image forming method.

2. Description of the Related Art

In electrophotographic image forming apparatuses, conventionally, a residual toner attached to the surface of an image bearing member after a toner image is transferred to a recording medium or an intermediate transfer body in an image forming step has been removed by a cleaning unit.

As the cleaning unit, a cleaning blade is used because of its simple configuration and excellent cleaning performance. The cleaning blade is usually composed of an elastic member made of a polyurethane rubber or the like, and a supporting member. The base end of the elastic member is supported by the supporting member, and an abutment part (tip ridge line part) of the elastic member is pressed on the surface of the image bearing member to retain a toner remaining on the surface of the image bearing member, scraping the toner off for removal.

However, as illustrated in FIG. 1A, in a cleaning blade 62 made of a polyurethane rubber, the cleaning blade 62 is pulled in the moving direction of an image bearing member 123 by the increase in friction force between the image bearing member 123 and the cleaning blade 62, and an abutment part (tip ridge line part) 62*c* of the cleaning blade 62 is thus exfoliated. Furthermore, if cleaning is continued while the abutment part 62*c* of the cleaning blade 62 being exfoliated, local abrasion X occurs at a position on a tip surface 62*a* of the cleaning blade 62, away from the abutment part 62*c* by several μm, as illustrated in FIG. 1B. If cleaning is further continued in such a state, the local abrasion X is increased, eventually resulting in the lack of the abutment part 62*c*, as illustrated in FIG. 1C. Such lack of the abutment part 62*c* causes a problem of making it impossible to normally remove toner by cleaning, causing cleaning failure. Herein, numeral 62*b* denotes a lower surface of the cleaning blade in FIG. 1A to FIG. 1C.

Then, in order to suppress exfoliation of the abutment part (tip ridge line part) of the cleaning blade, which abuts the surface of the image bearing member, it is attempted to increase the hardness of the abutment part, thereby hardly deforming the abutment part. For example, it has been proposed to provide a surface layer including an ultraviolet curable resin on an abutment part of a cleaning blade or an elastic member to increase the hardness of the abutment part, thereby preventing the abutment part from exfoliating and deforming (see Japanese Patent No. 3602898, Japanese Patent Application Laid-Open No. 2004-233818, and Japanese Patent Application Laid-Open No. 2010-152295).

However, the ultraviolet curable resin for use in such a proposal has a high crosslink density, and therefore, there is a problem that when the surface layer is provided on the abutment part, the cure shrinkage upon curing is high to cause cracking of the surface layer and peeling of the surface layer.

There is also a problem that if the durability of the cleaning blade is low, the pressing force of a charging roller cannot be increased to make unstable the contact state of the charging roller and an image bearing member, and a uniform charge potential is not achieved.

Accordingly, there is demanded for providing an image forming apparatus in which a cleaning blade capable of maintaining good cleanability over a long period is used to thereby make it possible to increase the pressing force of a charging roller, and the charge potential is stabilized without contamination of the charging roller to generate no linear abnormal image.

SUMMARY OF THE INVENTION

An object of the present invention is to provide an image forming apparatus in which a cleaning blade capable of maintaining good cleanability over a long period is used to thereby make it possible to increase the pressing force of a charging roller, and the charge potential is stabilized without contamination of the charging roller to generate no linear abnormal image.

The image forming apparatus of the present invention as a measure for solving the problems is an image forming apparatus including: an image bearing member; a charging unit configured to charge a surface of the image bearing member; an exposure unit configured to expose the charged surface of the image bearing member to light, to thereby form an electrostatic latent image; a developing unit configured to develop the electrostatic latent image with a toner to form a visible image; a transfer unit configured to transfer the visible image to a recording medium; a fixing unit configured to fix the transferred visible image on the recording medium; and a cleaning unit including a cleaning blade configured to remove the toner remaining on the image bearing member, wherein the charging unit includes a charging roller that is brought into contact with the image bearing member for charging the charging roller abutting the image bearing member at a pressing force of 10 mN/cm to 1,000 mN/cm, wherein the cleaning blade includes an elastic member that abuts the surface of the image bearing member to remove a residue attached to the surface of the image bearing member, and wherein an abutment part of the elastic member, which abuts the surface of the image bearing member, includes a cured product of an ultraviolet curable composition containing a (meth)acrylate compound having an alicyclic structure having 6 or more carbon atoms in a molecule.

The present invention can provide an image forming apparatus in which a cleaning blade capable of solving the conventional problems, achieving the object and maintaining good cleanability over a long period is used to thereby make it possible to increase the pressing force of a charging roller, and the charge potential is stabilized without contamination of the charging roller to generate no linear abnormal image.

DETAILED DESCRIPTION OF THE INVENTION

Figure 1A:
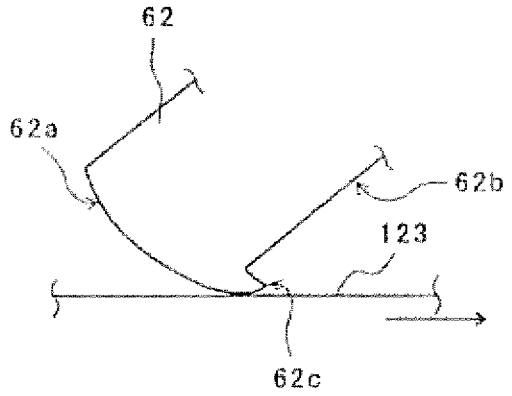
FIG. 1A prior art
FIG. 1A is a view illustrating a state where an abutment part of a conventional cleaning blade is exfoliated.

Image Forming Apparatus and Image Forming Method

The image forming apparatus of the present invention includes at least an image bearing member, a charging unit, an exposure unit, a developing unit, a transfer unit, a fixing unit and a cleaning unit, and further includes other units appropriately selected if necessary. Herein, the charging unit and the exposure unit may also be collectively referred to as an electrostatic latent image forming unit.

The image forming method of the present invention includes at least a charging step, an exposure step, a developing step, a transfer step, a fixing step and a cleaning step, and further other steps appropriately selected if necessary. Herein, the charging step and the exposure step may also be collectively referred to as an electrostatic latent image forming step.

The image forming method of the present invention can be suitably performed by the image forming apparatus of the present invention, the charging step can be performed by the charging unit, the exposure step can be performed by the exposure unit, the developing step can be performed by the developing unit, the transfer step can be performed by the transfer unit, the fixing step can be performed by the fixing unit, the cleaning step can be performed by the cleaning unit, and the other steps can be performed by the other units.

In the present invention, an abutment part of an elastic member of a cleaning blade in the cleaning unit, which abuts the surface of an image bearing member, includes a cured product of an ultraviolet curable composition containing a (meth)acrylate compound having an alicyclic structure having 6 or more carbon atoms in a molecule, and thus the surface of the cleaning blade is very hard. Therefore, no exfoliation of a tip ridge line part of the cleaning blade occurs, and no local abrasion occurs. Since no exfoliation occurs, toner hardly slips, resulting in the enhancement in cleanability and no contamination of a charging roller.

In addition, the cleaning blade capable of maintaining good cleanability over a long period is used, and thus a charging roller as the charging unit abuts the image bearing member at a pressing force of 10 mN/cm to 1,000 mN/cm to thereby stabilize the contact state of the charging roller and the image bearing member, achieving a uniform charge potential.

In addition, irregularities are circumferentially provided on the surface of the charging roller and the charging roller preferably has a ten-point average roughness Rz of 2 μm to 20 μm, and thus contact portions and gap portions are moderately dispersed to thereby stabilize the charge potential.

In addition, the number of functional groups in the (meth) acrylate compound having an alicyclic structure having 6 or more carbon atoms in a molecule is increased, and thus crosslinking of the ultraviolet curable composition on the surface of the cleaning blade can be promoted.

In addition, the (meth)acrylate compound having an alicyclic structure having 6 or more carbon atoms in a molecule preferably has a molecular weight of 500 or less, and thus the ultraviolet curable composition easily penetrates into the inside and is easily present on the surface of the cleaning blade.

<Image Bearing Member>

The image bearing member (hereinafter, sometimes referred to as "electrographic photosensitive member", or "photosensitive member") is not particularly limited in terms of the material, shape, structure, size, and the like thereof, and can be appropriately selected from known ones. Examples of the shape of the image bearing member include a drum shape and a belt shape. Examples of the material of the image bearing member include inorganic photosensitive members such as amorphous silicon and selenium, and organic photosensitive members (OPC) such as polysilane and phthalopolymethine. Among them, organic photosensitive members (OPC) are particularly preferable.

As the organic photosensitive member (OPC), a function separation type electrographic photosensitive member is applied in which a charge generation layer containing at least a charge generation agent is formed on a conductive supporting member and a charge transport layer containing at least a charge transport agent is formed thereon.

—Conductive Supporting Member—

Examples of the conductive supporting member include worked pieces of metal simple substances such as aluminum, brass, stainless steel, nickel, chromium, titanium, gold, silver, copper, tin, platinum, molybdenum and indium, and alloys thereof. The shape thereof may be any shape as long as it is flexible shape such as a sheet shape, a film shape, or a belt shape, and may or may not have an end.

Among them, aluminum alloys of JIS3000 series, JIS5000 series, JIS6000 series, and the like are used. Preferable is a conductive supporting member molded by a common method such as an EI (Extrusion Ironing) method, an ED (Extrusion Drawing) method, a DI (Drawing Ironing) method, or an II (Impact Ironing) method, and the conductive supporting member may be one whose surface is further subjected to a surface cutting process or polishing by a diamond turning tool or the like, and a surface treatment such as an anodizing treatment, or may be an uncut tube not subjected to the process and treatment.

When a resin is used for the supporting member, the resin can contain a conducting agent such as a metal powder or conductive carbon therein, or a conductive resin can be used as the resin for forming the supporting member. Furthermore, when a glass is used for the supporting member, the surface thereof may be covered with tin oxide, indium oxide, or aluminum iodide so as to have conductivity.

A resin layer may also be formed on the supporting member. The resin layer has a function of enhancing adhesion, a barrier function of preventing the influx current from an aluminum tube, and a function of covering defects on the surface of the aluminum tube. For the resin layer, various resins such as a polyethylene resin, an acrylic resin, an epoxy resin, a polycarbonate resin, a polyurethane resin, a vinyl chloride resin, a vinyl acetate resin, a polyvinyl butyral resin, a polyamide resin, a nylon resin, an alkyd resin, and a melamine resin can be used. The resin layer may be formed of a single resin, or may be formed of a mixture of two or more resins. In addition, a metal compound, carbon, silica, a resin powder, and the like can also be dispersed in the resin layer. Furthermore, in order to improve properties, various pigments, electron-accepting substances, electron-donating substances, and the like can also be contained therein.

The method for forming the charge generation layer is not particularly limited, and various methods can be used therefor. For example, the charge generation layer can be formed by applying an applying liquid, in which a phthalocyanine composition or a bisazo pigment used as the charge generation agent is dispersed or dissolved in a proper solvent together with a binder resin, on the supporting member serving as a predetermined base, and drying the resultant if necessary.

The charge transport layer has at least a charge transport agent described later, and the charge transport layer can be formed by binding the charge transport agent on, for example, the charge generation layer serving as a base by using the binder resin.

For the method for forming the charge transport layer, various methods can be used. Usually, a method can be used therefor which includes applying an applying liquid, in which the charge transport agent is dispersed or dissolved in a proper solvent together with the binder resin, on the charge generation layer serving as a base, and drying the resultant if necessary.

Herein, these methods can also be applied to a reverted lamination type electrographic photosensitive member in which the charge generation layer and the charge transport layer are laminated in reverse order, or the like. Furthermore, these methods can also be applied to a single layer type electrographic photosensitive member in which the charge generation agent and the charge transport agent are contained in the same layer.

As the charge generation agent, for example, oxytitanium phthalocyanine showing the maximum peak at a Bragg angle (2θ±0.2) of 27.2° in an X-ray diffraction spectrum measured by using CuKα as a radiation source, or a bisazo pigment represented by the following structural formula (1) is used.

resin, a diarylate resin, a polysulfone resin, a polyethersulfone resin, a polyarylsulfone resin, a silicone resin, a ketone resin, a polyvinyl butyral resin, a polyether resin, a phenol resin, an EVA (ethylene/vinyl acetate) resin, an ACS (acrylonitrile/chlorinated polyethylene/styrene) resin, an ABS (acrylonitrile/butadiene/styrene) resin, and epoxy acrylate. These may be used singly or in combination of two or more. In the case where resins having a different molecular weight are mixed and used, the case is preferable because hardness and abrasion resistance can be improved. In the case of a laminated structure, particularly, as the binder resin for forming the charge transport layer, preferable is a polycarbonate resin or a polyarylate resin, and particularly preferable is a polycarbonate resin.

Examples of a solvent for use in the applying liquid include alcohols such as methanol, ethanol, n-propanol, i-propanol and butanol; saturated aliphatic hydrocarbons such as pentane, hexane, heptane, octane, cyclohexane and cycloheptane; aromatic hydrocarbons such as toluene and xylene; chlorinated hydrocarbons such as dichloromethane, dichloroethane, chloroform and chlorobenzene; ethers such as dimethyl ether, diethyl ether, tetrahydrofuran (THF) and methoxyethanol; ketones such as acetone, methyl ethyl ketone, methyl isobutyl ketone and cyclohexanone; esters such as ethyl formate, propyl formate, methyl acetate, ethyl acetate, propyl acetate, butyl acetate and methyl propionate; ether-based solvents such as diethyl ether, dimethoxyethane, tetrahydrofuran, dioxolane, diaxane and anisole; and N,N-dimethylformamide and dimethylsulfoxide. These may be used singly or in combination of two or more. Among them, ketone-based solvents, ester-based solvents, ether-based solvents, or halogenated hydrocarbon-based solvents are preferable.

The charge transport agent includes a compound represented by the following general formula (1) or the following general formula (2).

<Structural Formula (1)>

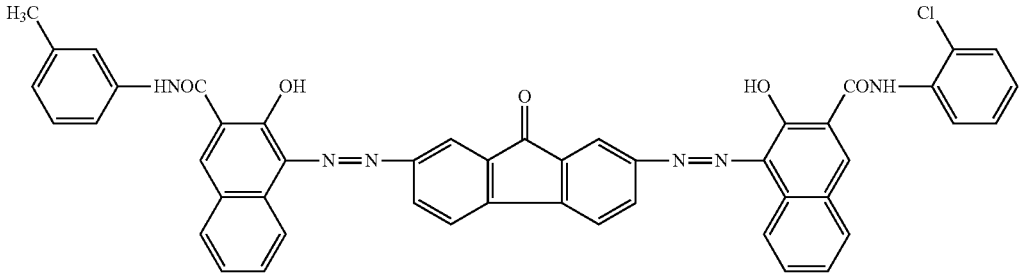

Herein, the oxytitanium phthalocyanine showing a diffraction peak indicated above or the bisazo pigment can be used to provide an electrographic photosensitive member having an excellent sensitivity in a long wavelength region and also exhibiting stable properties not affected by the usage environment, particularly, humidity.

In order to achieve an appropriate photosensitive wavelength and to sensitization action, the oxytitanium phthalocyanine, bisazo pigment, am pigment, or the like can also be used in the charge generation layer. Besides them, for example, a monoazo pigment, a bisazo pigment, a trisazo pigment, a polyazo pigment, an indigo pigment, a threne pigment, a toluidine pigment, a pyrazoline pigment, a perylene pigment, a quinacridone pigment, a pyrylium salt, and the like can be used.

Examples of the binder resin for forming the charge generation layer include a polycarbonate resin, a styrene resin, an acrylic resin, a styrene-acrylic resin, an ethylene-vinyl acetate resin, a polypropylene resin, a vinyl chloride resin, chlorinated polyether, a vinyl chloride-vinyl acetate resin, a polyester resin, a furan resin, a nitrile resin, an alkyd resin, a polyacetal resin, a polymethylpentene resin, a polyamide resin, a polyurethane resin, an epoxy resin, a polyarylate <General Formula (1)>

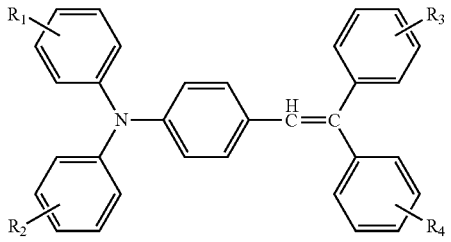

Herein, $R_1$ to $R_4$ in the general formula (1) each independently represent a hydrogen atom, an alkyl group having 1 to 6 carbon atoms and optionally having a substituent, or an alkoxy group having 1 to 6 carbon atoms and optionally having a substituent.

Specific examples of the compound represented by the general formula (1) are shown in the following Table A, but are not limited thereto.

TABLE A

| Charge transport agent | $R_1$ | $R_2$ | $R_3$ | $R_4$ |
|---|---|---|---|---|
| NO. 1-1 | Methyl group | Methyl group | Hydrogen atom | Hydrogen atom |
| NO. 1-2 | Methyl group | Methyl group | Methyl group | Methyl group |
| NO. 1-3 | Methyl group | Hydrogen atom | Methyl group | Hydrogen atom |
| NO. 1-4 | Hydrogen atom | Hydrogen atom | Methyl group | Methyl group |
| NO. 1-5 | Hydrogen atom | Hydrogen atom | Hydrogen atom | Hydrogen atom |

<General Formula (2)>

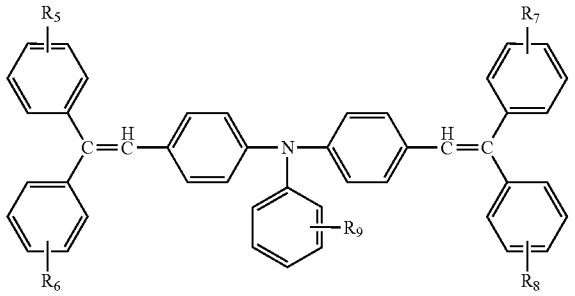

Herein, $R_5$ to $R_9$ in the general formula (2) each independently represent a hydrogen atom, an alkyl group having 1 to 6 carbon atoms and optionally having a substituent, or an alkoxy group having 1 to 6 carbon atoms and optionally having a substituent.

Specific examples of the compound represented by the general formula (2) are shown in the following Table B, but are not limited thereto.

TABLE B

| Charge transport agent | $R_5$ | $R_6$ | $R_7$ | $R_8$ | $R_9$ |
|---|---|---|---|---|---|
| NO. 2-1 | Methyl group | Methyl group | Methyl group | Methyl group | Methyl group |
| NO. 2-2 | Methyl group | Methyl group | Methyl group | Methyl group | Hydrogen atom |
| NO. 2-3 | Methyl group | Hydrogen atom | Methyl group | Hydrogen atom | Methyl group |
| NO. 2-4 | Methyl group | Methyl group | Methyl group | Methyl group | Ethyl group |
| NO. 2-5 | Hydrogen atom | Hydrogen atom | Hydrogen atom | Hydrogen atom | Hydrogen atom |

The content of the compound represented by the general formula (1) or the general formula (2) in the charge transport layer is preferably 30 parts by mass to 90 parts by mass and more preferably 40 parts by mass to 80 parts by mass based on 100 parts by mass of the binder resin.

If the content is less than 30 parts by mass, the deterioration in electric properties such as the increase in residual potential may be caused, and if the content exceeds 90 parts by mass, mechanical properties such as abrasion resistance may be deteriorated.

A particulate filler can also be added to the charge transport layer to thereby adjust the universal hardness and elastic power of the photosensitive member.

Examples of the particulate filler include titanium oxide, silica, a silicone rubber, alumina, zinc oxide, zirconium oxide, tin oxide, indium oxide, antimony trioxide, magnesium oxide, silicon nitride, boron nitride, calcium oxide, calcium carbonate, barium sulfate, silicone particles, PTFE particles, and PFA particles.

Since the photosensitive member is brought into contact with paper, a cleaning member, a contact-type charging member, and the like and the surface thereof is thus abraded, it is considered that not only the composition of a photosensitive member but also the elastic power and universal hardness thereof are important for preventing the photosensitive layer from abrading.

The charge transport agent represented by the general formula (1) or the general formula (2) and other charge transport agent can also be used singly, or mixed and used. In this case, the content ratio of the charge transport agent of the general formula (1) or the general formula (2) to other charge transport agent is preferably 50:50 to 95:5 and more preferably 70:30 to 95:5 in mass ratio.

Examples of the other charge transport agent include conductive high-molecular compounds such as polyvinylcarbazole, halogenated polyvinylcarbazole, polyvinylpyrene, polyvinylindoloquinoxaline, polyvinylbenzothiophene, polyvinylanthracene, polyvinylacridine, polyvinylpyrazoline, polyacetylene, polythiophene, polypyrrole, polyphenylene, polyphenylenevinylene, polyisothianaphthene, polyaniline, polydiacetylene, polyheptadiene, polypyridinediyl, polyquinoline, polyphenylene sulfide, polyferrocenylene, polyperinaphthylene and polyphthalocyanine.

Examples of a low-molecular compound include polycyclic aromatic compounds such as trinitrofluorenone, tetracyanoethylene, tetracyanoquinodimethane, quinone, diphenoquinone, naphthoquinone, anthraquinone, or derivatives thereof, anthracene, pyrene and phenanthrene; nitrogen-containing heterocyclic compounds such as indole, carbazole and imidazole; and fluorenone, fluorene, oxadiazole, oxazole, pyrazoline, hydrazone, triphenylmethane, triphenylamine, enamine and stilbene. Herein, a high-molecular solid electrolyte, in which a high-molecular compound such as polyethylene oxide, polypropylene oxide, polyacrylonitrile, or polymethacrylic acid is doped with a metal ion such as a Li ion, or the like, can also be used. Furthermore, an organic charge-transfer complex formed by an electron-donating compound and an electron-accepting compound, typified by tetrathiafulvalene-tetracyanoquinodimethane, or the like can also be used. These may be used singly or in combination of two or more.

An antioxidant, an ultraviolet absorber, a radical scavenger, a softener, a curing agent, a crosslinking agent, and the like can be added to the applying liquid in such an extent not to impair properties, to produce the electrographic photosensitive member, thereby enhancing properties, durability and mechanical properties of the photosensitive member. Particularly, the antioxidant and the ultraviolet absorber are used singly or in combination to thereby contribute to the enhancement in durability of the photosensitive member, and thus are useful. Among them, a hindered phenol-based antioxidant, an amine-based antioxidant, a sulfur-based antioxidant, and a benzotriazole-based ultraviolet absorber are preferable for the photosensitive layer.

Examples of the hindered phenol-based antioxidant include monophenol-based antioxidants such as 2,6-di-tert-butylphenol, 2,6-di-tert-4-methoxyphenol, 2-tert-butyl-4-methoxyphenol, 2,4-dimethyl-6-tert-butylphenol, 2,6-di-tert-butyl-4-methylphenol, butylated hydroxyanisole, stearyl-β-(3,5-di-tert-butyl-4-hydroxyphenyl)propionate, α-tocopherol, β-tocopherol and n-octadecyl-3-(3'-5'-di-tert-butyl-4'-hydroxyphenylpropionate, and polyphenol-based antioxidants such as 2,2'-methylenebis(6-tert-butyl-4-methylphenol), 4,4'-butylidene-bis-(3-methyl-6-tert-butylphenol), 4,4'-thiobis(6-tert-butyl-3-methylphenol), 1,1,3-tris(2-methyl-4-hydroxy-5-tert-butylphenyl)butane, 1,3,5-trimethyl-2,4,6-tris(3,5-di-tert-butyl-4-hydroxybenzyl) benzene and tetrakis[methylene-3 (3,5-di-tert-butyl-4-hydroxyphenyl)propionate]methane. These may be used singly or in combination of two or more.

Examples of the amine-based antioxidant include α,α'(tetrabenzyl)diamino-P-xylene, N-phenyl-1-naphthylamine, N-phenyl-N'-isopropyl-p-phenylenediamine, N,N-diethyl-p-phenylenediamine, N-phenyl-N'-ethyl-2-methyl-p-phenylenediamine, N-ethyl-N-hydroxyethyl-p-phenylenediamine, alkylated diphenylamine, N,N'-diphenyl-p-phenylenediamine, N,N'-diallyl-p-phenylenediamine, N-phenyl-1,3-dimethylbutyl-p-phenylenediamine, 4,4'-dioctyl-diphenylamine, 4,4'-dioctyl-diphenylamine, 6-ethoxy-2,2,4-trimethyl-1,2-dihydroquinoline, 2,2,4-trimethyl-1,2-dihydroquinoline, N-phenyl-β-naphthylamine, and N,N-di-2-naphthyl-p-phenylenediamine. These may be used singly or in combination of two or more.

Examples of the sulfur-based antioxidant include dilauryl-3,3-thiodipropionate, ditridecyl-3,3-thiodipropionate, dimyristyl-3,3-thiodipropionate, distearyl-3,3-thiodipropionate, laurylstearyl-3,3-thiopropionate, bis[2-methyl-4-(3-n-alkyl(C12 to C14)thiopropionate)-5-t-butylphenyl]sulfide, pentaerythritol tetra(β-lauryl-thiopropionate)ester, 2-mercaptobenzimidazole, and 2-mercapto-6-methylbenzimidazole. These may be used singly or in combination of two or more.

Examples of the ultraviolet absorber include benzotriazole-based ultraviolet absorbers such as 2-(5-methyl-2-hydroxyphenyl)benzotriazole, 2-[2-hydroxy-3,5-bis(α,α-dimethylbenzyl)phenyl]-2H-benzotriazole, 2-(3,5-di-tert-butyl-2-hydroxyphenyl)benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenylbenzotriazole and 2-(2'-hydroxy-5'-tert-octylphenyl)benzotriazole, and salicylate-based ultraviolet absorbers such as phenyl salicylate, p-tert-butylphenyl salicylate and p-octylphenyl salicylate. These may be used singly or in combination of two or more.

Preferably, the amount of the phenol-based antioxidant added to the image bearing member ranges from 1% by mass to 20% by mass based on that of binder resin, the amount of the amine-based antioxidant added ranges from 1% by mass to 20% by mass based on that of binder resin, and the amount of the sulfur-based antioxidant added ranges firm 0.1% by mass to 5% by mass based on that of binder resin. On the other hand, the amount of the ultraviolet absorber added preferably ranges from 1% by mass to 20% by mass based on that of binder resin.

Herein, a protective layer may be provided on the photosensitive layer by forming an organic thin film made of a polyvinylformal resin, a polycarbonate resin, a fluororesin a polyurethane resin, a silicone resin, or the like, or a thin film made of a siloxane structure farmed by a hydrolysate of a silane coupling agent, and such a case is preferable because durability of the image bearing member is enhanced. The protective layer may also be provided for enhancing functions other than the enhancement in durability.

<Charging Step and Charging Unit>

The charging step is a step of charging the surface of the image bearing member, and is performed by the charging unit.

The charging unit is a conductive or semiconductive roller and is in contact with the image bearing member.

In the charging roller, the pressing force to the image bearing member is 10 mN/cm to 1,000 mN/cm and preferably 100 mN/cm to 1,000 mN/cm in linear pressure.

If the pressing force is less than 10 mN/cm, the contact state of the charging roller and the image bearing member is not stable, a uniform charge potential is not achieved, and an abnormal image due to charging unevenness may be generated. On the other hand, if the pressing force exceeds 1,000 mN/cm, the torque of the image bearing member may be increased.

The pressing force can be measured by using, for example, a measurement apparatus into which a small-sized compression load cell manufactured by Kyowa Electronic Instruments Co., Ltd. is incorporated.

When the surface of the image bearing member is charged, a direct voltage may be applied, or direct and alternating voltages may be simultaneously applied.

The surface of the charging roller preferably has a ten-point average roughness Rz of 2 μm to 20 μm, more preferably 6 μm to 18 μm. If the ten-point average roughness Rz is less than 2 μm, a horizontally linear abnormal image may be generated, and if the Rz exceeds 20 μm, the surface is too rough and may be ununiformly charged.

The ten-point average roughness Rz is a ten-point average roughness Rz measured according to JIS B0601-1994 standard, and can be measured by using, for example, Surfcom 1400D (manufactured by Tokyo Seimitsu Co., Ltd.).

<Exposure Step and Exposure Unit>

The exposure step is a step of exposing the charged surface of the image bearing member, and is performed by the exposure unit.

The exposure can be performed by exposing the surface of the image bearing member in an image pattern by using, for example, the exposure unit.

The optical system in the exposure is roughly classified into an analog optical system and a digital optical system. The analog optical system is an optical system in which a manuscript is directly projected on the image bearing member by the optical system, and the digital optical system is an optical system in which image information is given as an electric signal and the image information is converted into a light signal to expose the electrographic photosensitive member for image creation.

The exposure unit is not particularly limited and can be appropriately selected depending on the purpose as long as it can exposure the surface of the image bearing member charged by the charging unit in an image pattern to be formed, and examples thereof include various exposure devices such as a copying optical system, a rod lens array system, a laser optical system, a liquid crystal shutter optical system and a LED optical system.

In the present invention, a rear light system which performs exposure from the back side of the image bearing member in an image pattern may be adopted.

<Developing Step and Developing Unit>

The developing step is a step of developing the electrostatic latent image using the toner to form a visible image.

The formation of the visible image can be performed, for example, by developing the electrostatic latent image using the toner, and can be performed by the developing unit.

The developing unit is not particularly limited and can be appropriately selected from known ones as long as it can perform developing, for example, using the toner, and examples thereof suitably include one at least having a developing device that can accommodate the toner to provide the toner to the electrostatic latent image in a contact or noncontact manner.

The developing device may have any of a dry developing system and a wet developing system, may be a developing device for single color or a developing device for multicolor, and examples thereof suitably include one having a stirrer, in which the toner is stirred and frictionally charged, and a rotatable magnetic roller.

In the developing device, for example, the toner and, if necessary, a carrier are mixed and stirred, the toner is charged by the friction upon such mixing and stirring and held on the surface of the rotating magnetic roller in the state of napping, and a magnetic brush is formed. Since the magnetic roller is arranged in the vicinity of the image bearing member, a part of the toner that constitutes the magnetic brush formed on the surface of the magnetic roller is moved toward the surface of the image bearing member by electrical attraction. As a result, the electrostatic latent image is developed by the toner to form a visible image by the toner on the surface of the image bearing member.

The toner accommodated in the developing device may be a developer including the toner, and the developer may be a one-component developer or a two-component developer.

—Toner—

The toner contains toner base particles and an external additive, and further contains other components if necessary.

The toner may be any of a monochrome toner and a color toner.

The toner base particles contain at least a binder resin and a colorant, and contain other components such as a release agent and a charge controlling agent, if necessary.

—Binder Resin—

The binder resin is not particularly limited and can be appropriately selected depending on the purpose, and examples thereof include styrene or substituted styrene homopolymers, such as a polystyrene resin and a polyvinyltoluene resin, a styrene-p-chlorostyrene copolymer, a styrene-propylene copolymer, a styrene-vinyltoluene copolymer, a styrene-methyl acrylate copolymer, a styrene-ethyl acrylate copolymer, a styrene-butyl acrylate copolymer, a styrene-methyl methacrylate copolymer, a styrene-ethyl methacrylate copolymer, a styrene-butyl methacrylate copolymer, a styrene-α-chloromethyl methacrylate copolymer, a styrene-acrylonitrile copolymer, a styrene-vinylmethylether copolymer, a styrene-vinylmethylketone copolymer, a styrene-butadiene copolymer, a styrene-isoprene copolymer, a styrene-maleic acid copolymer, a styrene-maleate copolymer, polymethyl methacrylate, polybutyl methacrylate, a polyvinyl chloride resin, a polyvinyl acetate resin, a polyethylene resin, a polypropylene resin, a polyester resin, a polyurethane resin, an epoxy resin, a polyvinyl butyral resin, a polyacrylic acid resin, rosin, modified rosin, a terpene resin, a phenol resin, aliphatic hydrocarbon, an aromatic-based petroleum resin, chlorinated paraffin, and paraffin wax. These may be used singly or in combination of two or more. Among them, a polyester resin is particularly preferable because it can reduce melt viscosity while ensuring the stability of toner during storage as compared with a styrene-based resin and an acrylic resin.

The polyester resin can be obtained by, for example, a polycondensation reaction of an alcohol component and a carboxylic component.

The alcohol component is not particularly limited and can be appropriately selected depending on the purpose, and examples thereof include diols such as polyethylene glycol diethylene glycol triethylene glycol 1,2-propylene glycol, 1,3-propylene glycol, 1,4-propylene glycol, neopentyl glycol and 1,4-butenediol; etherified bisphenols such as 1,4-bis(hydroxymethyl)cyclohexane, bisphenol A, hydrogenated bisphenol A, polyoxyethylenated bisphenol A and polyoxypropylenated bisphenol A; dihydric alcohol monomers obtained by substituting each of these diols with a saturated or unsaturated hydrocarbon group having 3 to 22 carbon atoms; other dihydric alcohol monomers; and trihydric or higher polyhydric alcohol monomers such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol 2-methylpropanetriol, 2-methyl-1,2,4-butanetriol, trimethylolethane, trimethylolpropane and 1,3,5-trihydroxymethylbenzene.

The carboxylic component is not particularly limited and can be appropriately selected depending on the purpose, and examples thereof include monocarboxylic acids such as palmitic acid, stearic acid and oleic acid; maleic acid, fumaric acid, mesaconic acid, citraconic acid, terephthalic acid, cyclohexanedicarboxylic acid, succinic acid, adipic acid, sebacic acid, malonic acid, divalent organic acid monomers in which each of these acids is substituted with a saturated or unsaturated hydrocarbon group having 3 to 22 carbon atoms, anhydrides of these acids, and dimer acids from a lower alkyl ester and linoleic acid; and trivalent or higher polycarboxylic acid monomers such as 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 3,3-dicarboxymethyl butanoic acid, tetra(carboxymethyl)methane, 1,2,7,8-octanetetracarboxylic acid, Enbol trimer acid and acid anhydrides thereof.

—Colorant—

The colorant is not particularly limited and can be appropriately selected from known dyes and pigments depending on the purpose, and examples thereof include carbon black, a nigrosine dye, black iron oxide, Naphthol Yellow S, Hansa Yellow (10G, 5G, G), cadmium yellow, yellow iron oxide, yellow ochre, chrome yellow, Titan Yellow, Polyazo Yellow, Oil Yellow, Hansa Yellow (GR, A, RN, R), Pigment Yellow L. Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red iron oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K Hello Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxane violet, Anthraquinone Violet, chrome green, zinc green, chrome oxide, Persian, emerald green, Pigment Green B, Naphthol Green B, Green Gold, Acid Green Lake, Malachite Green Lake, Phthalocyanine Green, Anthraquinone Green, titanium oxide, zinc white, and lithopone. These may be used singly or in combination of two or more.

The content of the colorant in the toner is not particularly limited and can be appropriately selected depending on the purpose, but it is preferably 1% by mass to 15% by mass, and more preferably 3% by mass to 10% by mass.

The colorant may be used as a masterbatch combined with a resin. The resin is not particularly limited and can be appropriately selected from known ones depending on the purpose, and examples thereof include styrene or a substituted styrene polymer, a styrene-based copolymer, a polymethyl methacrylate resin, a polybutyl methacrylate resin, a polyvinyl chloride resin, a polyvinyl acetate resin, a polyethylene resin, a polypropylene resin, a polyester resin, an epoxy resin, an epoxypolyol resin, a polyurethane resin, a polyamide resin, a polyvinyl butyral resin, a polyacrylic acid resin, rosin, modified rosin, a terpene resin, an aliphatic hydrocarbon resin, an alicyclic hydrocarbon resin, an aromatic-based petroleum resin, chlorinated paraffin, and paraffin. These may be used singly or in combination of two or more.

—Release Agent—

The release agent is not particularly limited and can be appropriately selected depending on the purpose, and examples thereof include waxes.

Examples of the waxes include carbonyl group-containing wax, polyolefin wax, and long-chain hydrocarbon. These may be used singly or in combination of two or more. Among them, carbonyl group-containing wax is preferable.

Examples of the carbonyl group-containing wax include polyalkanoic acid ester, polyalkanol ester, polyalkanoic acid amide, polyalkylamide, and dialkylketone. Examples of the polyalkanoic acid ester include carnauba wax, montan wax, trimethylolpropane tribehenate, pentaerythritol tetrabehenate, pentaerythritol diacetate dibehenate, glycerin tribehenate, and 1,18-octadecanediol distearate. Examples of the polyalkanol ester include tristearyl trimellitate and distearyl maleate. Examples of the polyalkanoic acid amide include dibehenylamide. Examples of the polyalkylamide include trimellitic acid tristearylamide. Examples of the dialkylketone include distearylketone. Among these carbonyl group-containing waxes, polyalkanoic acid ester is particularly preferable.

Examples of the polyolefin wax include polyethylene wax and polypropylene wax.

Examples of the long-chain hydrocarbon include paraffin wax and Sasol Wax.

The content of the release agent in the toner is not particularly limited and can be appropriately selected depending on the purpose, but it is preferably 5% by mass to 15% by mass.

—Charge Controlling Agent—

The charge controlling agent is not particularly limited and can be appropriately selected depending on the purpose, and examples thereof include a nigrosine-based dye, a triphenylmethane-based dye, a chromium-containing metal complex dye, a chelate molybdate pigment, a rhodamine-based dye, alkoxy-based amine, a quaternary ammonium salt (including a fluorine-modified quaternary ammonium salt), alkylamide, a phosphorus simple substance or a phosphorus-containing compound, a tungsten simple substance or a tungsten-containing compound, a fluorine-based activator, a metal salt of salicylic acid, and a metal salt of a salicylic acid derivative.

The content of the charge controlling agent is not particularly limited and can be appropriately selected depending on the purpose, but it is preferably 0.1 parts by mass to 10 parts by mass and more preferably 0.2 parts by mass to 5 parts by mass based on 100 parts by mass of the toner.

—External Additive—

The external additive is not particularly limited and can be appropriately selected depending on the purpose as long as it contains at least silica particles. The external additive may also include, for example, inorganic particles such as silica, titanium oxide, alumina, silicon carbide, silicon nitride and boron nitride; and resin particles such as polymethyl methacrylate particles and polystyrene particles having an average particle diameter of 0.05 μm to 1 μm obtained by a soap-free emulsion polymerization method. These may be used singly or in combination of two or more. Among them, silica whose surface is subjected to a hydrophobization treatment is particularly preferable.

Examples of the silica include silicone-treated silica. The silicone-treated silica means silica whose surface is subjected to a surface treatment (hydrophobization treatment) by a silicone oil.

The surface treatment method is not particularly limited and can be appropriately selected depending on the purpose.

Examples of the silicone oil include a dimethyl silicone oil, a methyl hydrogen silicone oil, and a methylphenyl silicone oil.

As the silicone-treated silica, a commercially available product can be used. Examples of the commercially available product include RY200, R2T200S, NY50, and RY50 (all produced by Nippon Aerosil Co., Ltd.).

—Other Components—

The other components in the toner are not particularly limited and can be appropriately selected depending on the purpose, and examples thereof include a fluidity improver, a cleanability improver, a magnetic material, and a metal soap.

The fluidity improver is one that can enhance hydrophobicity by a surface treatment to prevent deteriorations in flow property and charging property even under a high humidity, and examples thereof include a silane coupling agent, a silylating agent, a silane coupling agent having a fluorinated alkyl group, an organic titanate-based coupling agent, an aluminum-based coupling agent, a silicone oil, and a modified silicone oil.

The cleanability improver is added to the toner in order to remove a toner after transfer, which remains on the image bearing member and the intermediate transfer body, and examples thereof include fatty acid metal salts such as zinc stearate, calcium stearate and stearic acid; and polymer fine particles produced by a soap-free emulsion polymerization, such as polymethyl methacrylate fine particles and polystyrene fine particles. As the polymer fine particles, preferable is one showing a relatively narrow particle size distribution, and suitable is one having a volume average particle diameter of 0.01 μm to 1 μm.

The magnetic material is not particularly limited and can be appropriately selected depending on the purpose, and examples thereof include an iron powder, magnetite, and ferrite. Among them, a white magnetic material is preferable in terms of color tone.

—Method for Producing Toner—

The method for producing the toner is not particularly limited and can be appropriately selected from conventionally known methods for producing toner depending on the purpose, and examples thereof include a kneading and pulverizing method, a polymerization method, a dissolution suspension method, and a spray granulation method. Among them, polymerization methods such as a suspension polymerization method, an emulsion polymerization method, and a dispersion polymerization method, by which high circularity and small particle diameter are easily achieved, are preferable for the increase in image quality.

—Kneading and Pulverizing Method—

The kneading and pulverizing method is, for example, a method in which a toner material containing at least a binder resin and a colorant is melt-kneaded, the resulting kneaded product is pulverized and classified, thereby producing base particles of the toner.

In the melt-kneading, the toner material is mixed and the mixture is loaded to a melt-kneader to be melt-knead. As the melt-kneader, for example, a single- or twin-screw continuous kneader, or a batch type kneader by a roll mill can be used. For example, a KTK type twin-screw extruder manufactured by Kobe Steel., Ltd., a TEM type extruder manufactured by Toshiba Machine Co., Ltd., a twin-screw extruder manufactured by KCK Co. Ltd., a PCM type twin-screw extruder manufactured by Ikegai Tekkosho K.K., and a cokneader manufactured by Buss Co., Ltd. are suitably used. This melt-kneading is preferably performed under such a proper condition as not to cause cleavage of the molecular chain of the binder resin. Specifically, the melt-knead temperature is set with reference to the softening point of the binder resin. When the melt-kneading temperature is too higher than the softening point, the cleavage occurs severely, and when the melt-kneading temperature is too lower, dispersion may not proceed.

In the pulverizing, the kneaded product obtained by the melt-kneading is pulverized. In this pulverizing, it is preferable that the kneaded product be first coarsely pulverized and then finely pulverized. In this case, a system in which the kneaded product is allowed to collide against an impact plate in a jet stream to thereby be pulverized, a system in which particles are allowed to collide against each other in a jet stream to thereby be pulverized, or a system in which particles are pulverized in a narrow gap between a rotor which mechanically rotates and a stator is preferably used.

In the classification, the pulverized product obtained by the pulverizing is classified for adjustment so that particles have a predetermined particle diameter. The classification can be performed by removing a part of fine particles with, for example, a cyclone, a decanter, or a centrifuge.

After completion of the pulverizing and classification, the pulverized product is classified in airflow by a centrifugal force or the like, and thus toner base particles having a predetermined particle diameter can be produced.

Then, an external additive is externally added to the toner base particles. The toner base particles and the external additive are mixed and stirred using a mixer, and thus the external additive covers the surface of the toner base particles while being ground. At this time, it is important in terms of durability to uniformly and firmly attach the external additive such as silica particles to the toner base particles.

—Polymerization Method—

In the method for producing toner by the polymerization method, for example, a toner material including at least a urea or urethane bondable modified polyester-based resin and a colorant is dissolved or dispersed in an organic solvent. Then, the product by such dissolving or dispersing is dispersed in an aqueous medium and subjected to a polyaddition reaction, and the solvent of this dispersion is removed, followed by washing to obtain the toner.

Examples of the urea or urethane bondable modified polyester-based resin include a polyester prepolymer having an isocyanate group, which is obtained by reacting a carboxyl group or a hydroxyl group at the terminal of a polyester with a polyvalent isocyanate compound (PIC). Then, a modified polyester resin obtained by crosslinking and/or extension of the molecular chain by the reaction of this polyester prepolymer with amines or the like can enhance hot offset property while maintaining low-temperature fixing property.

Examples of the polyvalent isocyanate compound (PIC) include aliphatic polyvalent isocyanates (for example, tetramethylene diisocyanate, hexamethylene diisocyanate, and 2,6-diisocyanatomethyl caproate); alicyclic polyisocyanates (for example, isophorone diisocyanate and cyclohexylmethane diisocyanate); aromatic diisocyanates (for example, tolylene diisocyanate and diphenylmethane diisocyanate); araliphatic diisocyanates (for example, α,α,α',α'-tetramethylxylylene diisocyanate); isocyanates; and those obtained by blocking the polyisocyanate with a phenol derivative, oxime, caprolactam, or the like. These may be used singly or in combination of two or more.

The ratio of the polyvalent isocyanate compound (PIC) is not particularly limited and can be appropriately selected depending on the purpose, but it is preferably 5/1 to 1/1, more preferably 4/1 to 1.2/1, and further preferably 2.5/1 to 1.5/1, as an equivalent ratio [NCO]/[OH] of an isocyanate group [NCO] to a hydroxyl group [OH] of a polyester having a hydroxyl group.

The number of isocyanate groups contained in one molecule in the polyester prepolymer having an isocyanate group (A) is not particularly limited and can be appropriately selected depending on the purpose, but it is preferably 1 or more, more preferably 1.5 to 3, and further preferably 1.8 to 2.5 on average.

Examples of the amines (B) to be reacted with the polyester prepolymer include a divalent amine compound (B1), a trivalent or higher polyvalent amine compound (B2), an aminoalcohol (B3), an aminomercaptan (B4), an amino acid (B5), and a compound in which an amino group of each of B1 to B5 is blocked (B6).

Examples of the divalent amine compound (B1) include aromatic diamines (for example, phenylenediamine, diethyltoluenediamine, and 4,4'-diaminodiphenylmethane); alicyclic diamines (for example, 4,4'-diamino-3,3'-dimethyldicyclohexylmethane, diaminecyclohexane, and isophoronediamine); and aliphatic diamines (for example, ethylenediamine, tetramethylenediamine, and hexamethylenediamine).

Examples of the trivalent or higher polyvalent amine compound (B2) include diethylenetriamine and triethylenetetramine.

Examples of the aminoalcohol (B3) include ethanolamine and hydroxyethylaniline.

Examples of the aminomercaptan (B4) include aminoethylmercaptan and aminopropylmercaptan.

Examples of the amino acid (B5) include aminopropionic acid and aminocaproic acid.

Examples of the compound in which an amino group of each of B1 to B5 is blocked (B6) include a ketimine compound and an oxazolidine compound, which are obtained from the amines B1 to B5 and ketones (for example, acetone, methyl ethyl ketone, and methyl isobutyl ketone). Among these amines (B), B1 and a mixture of B1 and a small amount of B2 are particularly preferable.

The ratio of the amines (B) is not particularly limited and can be appropriately selected depending on the purpose, but it is preferably 1/2 to 2/1, more preferably 1.5/1 to 1/1.5, and further preferably 1.2/1 to 1/1.2 as an equivalent ratio [NCO]/[NHx] of an isocyanate group [NCO] in the polyester prepolymer having an isocyanate group (A) to an amino group [NHx] in the amines (B).

According to the method for producing toner by the polymerization method, a toner having a small particle diameter and a spherical shape can be preferred with less environmental load at low cost.

The disperser for the dispersing is not particularly limited and can be appropriately selected depending on the purpose, and examples thereof include a low-speed shearing-type disperser, a high-speed shearing-type disperser, a friction-type disperser, a high-pressure jet-type disperser, and an ultrasonic disperser.

Among them, a high-speed shearing-type disperser is preferable from the viewpoint of being capable of controlling the particle diameter of a dispersant (oil droplet) to 2 μm to 20 μm.

When the high-speed shearing-type disperser is used, conditions such as rotation number, dispersing time, and dispersing temperature can be appropriately selected depending on the purpose.

The rotation number is not particularly limited and can be appropriately selected depending on the purpose, but it is preferably 1,000 rpm to 30,000 rpm and more preferably 5,000 rpm to 20,000 rpm.

The dispersing time is not particularly limited and can be appropriately selected depending on the purpose, but it is preferably 0.1 minutes to 5 minutes in the case of a batch system.

The dispersing temperature is not particularly limited and can be appropriately selected depending on the purpose, but it is preferably 0° C. to 150° C. and more preferably 40° C. to 98° C. under pressure. In general, when the dispersing temperature is higher, dispersing is more easily performed.

When the toner material is dispersed in an aqueous medium, the amount of the aqueous medium used is not particularly limited and can be appropriately selected depending on the purpose. However, the amount is preferably 50 parts by mass to 2,000 parts by mass and more preferably 100 parts by mass to 1,000 parts by mass based on 100 parts by mass of the toner material.

The method for removing the organic solvent from the dispersion liquid is not particularly limited and can be appropriately selected depending on the purpose, and examples thereof include a method in which the temperature of the entire reaction system is gradually raised to evaporate the organic solvent in oil droplets, and a method in which the dispersion liquid is sprayed in a dry atmosphere to remove the organic solvent in oil droplets.

The organic solvent is removed, and thus toner base particles are formed. The toner base particles can be subjected to washing, drying, and the like, and can be further subjected to classification. The classification may be performed by removing a part of fine particles with a cyclone, a decanter, centrifugation, or the like in the liquid, or the classification operation may be performed after drying.

The resulting toner base particles may be mixed with particles of the external additive, and if necessary the charge controlling agent, and the like. At this time, a mechanical impact power is applied to thereby make it possible to suppress the detachment of particles of the external additive and the like from the surface of the toner base particles.

The method for applying the mechanical impact power is not particularly limited and can be appropriately selected depending on the purpose, and examples thereof include a method in which an impact power is applied using a high-speed rotating blade, and a method in which a mixture is loaded into high-speed airflow for acceleration to thereby allow particles to collide against each other or against a proper impact plate.

The apparatus for use in the method is not particularly limited and can be appropriately selected depending on the purpose, and examples thereof include Ong MILL (manufactured by Hosokawa Micron Corporation), an I-type mill (manufactured by Nippon Pneumatic Mfg Co., Ltd.) modified so as to reduce the pulverizing air pressure, Hybridization System (manufactured by Nara Machinery Co., Ltd.), Cryptron System (manufactured by Kawasaki Heavy Industries, Ltd.), and an automatic mortar.

The average circularity of the toner is not particularly limited and can be appropriately selected depending on the purpose, but it is preferably 0.97 or more and more preferably 0.97 to 0.98. When the average circularity is less than 0.97, a satisfactory transfer property and a high quality image having no dust particles may not be obtained.

The average circularity of the toner can be measured using, for example, a flow-type particle image analyzer FPIA-1000 manufactured by Sysmex Corporation.

The volume average particle diameter of the toner is not particularly limited and can be appropriately selected depending on the purpose, but it is preferably 5.5 μm or less.

The ratio (Dv/Dn) of the volume average particle diameter (Dv) to the number average particle diameter (Dn) is not particularly limited and can be appropriately selected depending on the purpose, but it is preferably 1.00 to 1.40. As the ratio (Dv/Dn) is closer to 1.00, the particle diameter distribution is sharper. Such a toner that has a small particle diameter and a narrow particle diameter distribution has a uniform charge amount distribution and can provide a high quality image having less background fouling, and can also increase the transfer rate in an electrostatic transfer system.

The volume average particle diameter and the particle size distribution of the toner can be measured by, for example, Coulter Counter TA-II, Coulter Multisizer II (both are manufactured by Beckman Coulter, Inc.), or the like as a measurement apparatus of the particle size distribution of toner particles by the Coulter Counter method.

The toner can be used as a two-component developer with being mixed with a magnetic carrier. In this case, the mass ratio of the carrier to the toner in the two-component developer is not particularly limited and can be appropriately selected depending on the purpose, but the amount of the toner is preferably 1 part by mass to 10 parts by mass based on 100 parts by mass of the carrier.

Examples of the magnetic carrier include an iron powder, a ferrite powder, a magnetite powder, and a magnetic resin carrier, having a particle diameter of about 20 μm to 200 μm.

The covering resin is not particularly limited and can be appropriately selected depending on the purpose, and examples thereof include a urea-formaldehyde resin, a melamine resin, a benzoguanamine resin, a urea resin, a polyamide resin, an epoxy resin, a polyvinyl and polyvinylidene-based resin, an acrylic resin, a polymethyl methacrylate resin, a polyacrylonitrile resin, a polyvinyl acetate resin, a polyvinyl alcohol resin, a polyvinyl butyral resin, a polystyrene resin, a styrene-acrylic copolymerized resin, and a halogenated olefin resin such as polyvinyl chloride; polyester-based resins such as a polyethylene terephthalate resin and a polybutylene terephthalate resin; a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer such as a terpolymer of tetrafluoroethylene, vinylidene fluoride and a nonfluorinated monomer, and a silicone resin.

The covering resin may further contain a conductive powder and the like if necessary. Examples of the conductive powder include a metal powder, carbon black, titanium oxide, tin oxide, and zinc oxide. As such a conductive powder, one having an average particle diameter of 1 μm or less is preferable. When the average particle diameter exceeds 1 μm, it may be difficult to control electric resistance.

Herein, the toner can also be used as a one-component magnetic toner using no carrier, or a non-magnetic toner.

<Transfer Step and Transfer Unit>

The transfer step is a step of transferring the visible image to a recording medium. Preferably, the transfer step includes using an intermediate transfer body to primarily transfer the visible image on the intermediate transfer body, and then secondly transferring the visible image on the recording medium. More preferably, the transfer step includes a primary transfer step of using toners of two or more colors, preferably a full-color toner as the toner to transfer the visible image on an intermediate transfer body, forming a composite transfer image, and a secondary transfer step of transferring the composite transfer image on a recording medium.

The transfer can be performed by, for example, charging the image bearing member to thereby transfer the visible image using a transfer unit, and can be performed by the transfer unit. Preferably, the transfer unit has a primary transfer unit that transfers the visible image on an intermediate transfer body to form a composite transfer image, and a secondary transfer unit that transfers the composite transfer image on a recording medium.

The intermediate transfer body is not particularly limited and can be appropriately selected from known transfer bodies depending on the purpose, and examples thereof include a transfer belt.

The transfer unit (the primary transfer unit and the secondary transfer unit) preferably has at least a transfer device in which the visible image formed on the image bearing member is separated and charged to the recording medium. The transfer unit may be one unit or two or more units. Examples of the transfer device include a corona transfer device by corona discharge, a transfer belt, a transfer roller, a pressure transfer roller, and an adhesion transfer device.

Herein, the recording medium is typically plain paper, but is not particularly limited and can be appropriately selected depending on the purpose as long as it can transfer an image that is not fixed after development, and a PET base for OHP can also be used therefor.

<Fixing Step and Fixing Unit>

The fixing step is a step of fixing a toner image transferred on the recording medium, and the toner image can be fixed using a fixing unit. When toner of two or more colors is used, an image may be fixed every time when toner of each color is transferred on the recording medium, or may be fixed in the state where toner of all colors is transferred on the recording medium to be stacked. The fixing unit is not particularly limited and a heat fixing system using a known heating and pressurizing unit can be employed therefor. Examples of the heating and pressurizing unit include one in which a heating roller and a pressurizing roller are combined, and one in which a heating roller, a pressurizing roller and an endless belt are combined. At this time, the heating temperature is not particularly limited and can be appropriately selected depending on the purpose, but it is preferably 80° C. to 200° C. Herein, for example, a known photofixing device may be used with the fixing unit if necessary.

<Cleaning Step and Cleaning Unit>

The cleaning step is a step of removing the toner remaining on the image bearing member and can be suitably performed by a cleaning unit.

As the cleaning unit, the cleaning blade of the present invention is used.

The cleaning blade has an elastic member that abuts the surface of the image bearing member to remove a residue attached to the surface of the image bearing member, and has a supporting member, and also other member if necessary.

The cleaning blade is preferably composed of a supporting member, and a plate-shaped elastic member whose one end is connected to the supporting member and other end has a free end having a predetermined length. The cleaning blade is arranged so that an abutment part that is one end at the free end of the elastic member abuts the surface of the image bearing member along the longitudinal direction.

<<Residue>>

The residue is not particularly limited and can be appropriately selected depending on the purpose as long as it attaches to the surface of the image bearing member and is to be removed by the cleaning blade, and examples thereof include toner, a lubricant, inorganic fine particles, organic fine particles, foreign particles, dust, or a mixture thereof.

<<Supporting Member>>

The supporting member is not particularly limited with respect to the shape, size, material and the like thereof and can be appropriately selected depending on the purpose. Examples of the shape of the supporting member include a plate shape, a strip shape, and a sheet shape. The size of the supporting member is not particularly limited, and can be appropriately selected depending on the size of the image bearing member.

Examples of the material of the supporting member include a metal, a plastic, and a ceramic. Among them, a metal plate is preferable, and a steel plate such as stainless steel, an aluminum plate, and a phosphor bronze plate are particularly preferable in terms of strength.

<<Elastic Member>>

The elastic member is not particularly limited with respect to the shape, size, material and the like there and can be appropriately selected depending on the purpose. Examples of the shape of the elastic member include a plate shape, a strip shape, and a sheet shape. The size of the elastic member is not particularly limited, and can be appropriately selected depending on the size of the image bearing member.

The material of the elastic member is not particularly limited and can be appropriately selected depending on the purpose, but a polyurethane rubber, a polyurethane elastomer, and the like are suitable from the viewpoint of easily achieving high elasticity.

The elastic member is not particularly limited and can be appropriately selected depending on the purpose, and is produced by, for example, using a polyol compound and a polyisocyanate compound to prepare a polyurethane prepolymer, adding to the polyurethane prepolymer a curing agent and if necessary a curing catalyst for crosslinking in a predetermined mold and post-crosslinking in a furnace, molding the resultant into a sheet by centrifugal molding, then leaving the sheet to stand at ordinary temperature for aging, and cutting the resultant in the shape of a plate having a predetermined dimension.

The polyol compound is not particularly limited and can be appropriately selected depending on the purpose, and examples thereof include a high molecular weight polyol and a low molecular weight polyol.

Examples of the high molecular weight polyol include a polyester polyol that is a condensation product of an alkylene glycol and an aliphatic dibasic acid; polyester-based polyols, for example, polyester polyols of an alkylene glycol and adipic acid, such as ethylene adipate ester polyol, butylene adipate ester polyol, hexylene adipate ester polyol, ethylenepropylene adipate ester polyol, ethylenebutylene adipate ester polyol, and ethyleneneopenthylene adipate ester polyol; polycaprolactone-based polyols such as polycaprolactone ester polyol obtained by ring-opening polymerization of caprolactone and polyether-based polyols such as poly(oxytetramethylene)glycol and poly(oxypropylene)glycol. These may be used singly or in combination of two or more.

Examples of the low molecular weight polyol include dihydric alcohols such as 1,4-butanediol, ethylene glycol, neopentyl glycol, hydroquinone-bis(2-hydroxyethyl)ether, 3,3'-dichloro-4,4'-diaminodiphenylmethane, and 4,4'-diaminodiphenylmethane; and trihydric or higher polyhydric alcohols such as 1,1,1-trimethylolpropane, glycerin, 1,2,6-hexanetriol, 1,2,4-butanetriol, trimethylolethane, 1,1,1-tris(hydroxyethoxymethyl)propane, diglycerin, and pentaerythritol. These may be used singly or in combination of two or more.

The polyisocyanate compound is not particularly limited and can be appropriately selected depending on the purpose, and examples thereof include methylene diphenyl diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDI), hydrogenated xylylene diisocyanate ($H_6$XDI), dicyclohexyl methane diisocyanate ($H_{12}$MDI), hexamethylene diisocyanate (HDI), dimer acid diisocyanate (DDI), norbornene diisocyanate (NBDI), and trimethyl hexamethylene diisocyanate (TMDI). These may be used singly or in combination of two or more.

The curing catalyst is not particularly limited and can be appropriately selected depending on the purpose, and examples thereof include 2-methylimidazole and 1,2-dimethylimidazole.

The content of the curing catalyst is not particularly limited and can be appropriately selected depending on the purpose, but it is preferably 0.01% by mass to 0.5% by mass and more preferably 0.05% by mass to 0.3% by mass.

The JIS-A hardness of the elastic member is not particularly limited and can be appropriately selected depending on the purpose, but it is preferably 60 degrees or more and more preferably 65 degrees to 80 degrees. When the JIS-A hardness is less than 60 degrees, blade linear pressure is hardly achieved and the area of a part abutting the image bearing member is easily enlarged, thereby sometimes causing cleaning failure.

The elastic member is not particularly limited and can be appropriately selected depending on the purpose, but a laminate in which two or more rubbers having different JIS-A hardnesses are integrally molded is preferably used from the viewpoint of being capable of simultaneously satisfying abrasion resistance and followability.

Herein, the JIS-A hardness of the elastic member can be measured using, for example, a micro rubber hardness meter MD-1, manufactured by Kobunshi Keiki Co., Ltd.

The repulsive elastic modulus of the elastic member according to JIS K6255 standard is not particularly limited and can be appropriately selected depending on the purpose, but it is preferably 35% or less and more preferably 20% to 30% at 23° C. When the repulsive elastic coefficient exceeds 35%, tackiness is caused in the elastic member of the cleaning blade, thereby sometimes causing cleaning failure.

Herein, the repulsive elastic coefficient of the elastic member can be measured, for example, at 23° C. according to JIS K6255 standard using a resilience tester, No. 221, manufactured by Toyo Seiki Seisaku-Sho, Ltd.

The average thickness of the elastic member is not particularly limited and can be appropriately selected depending on the purpose, but it is preferably 1.0 mm to 3.0 mm.

The abutment part that abuts the surface of the image beating member of the elastic member includes a cured product of an ultraviolet curable composition containing a (meth) acrylate compound having an alicylic structure having 6 or more carbon atoms in a molecule.

The "abutment part including a cured product of an ultraviolet curable composition containing a (meth)acrylate compound having an alicyclic structure having 6 or more carbon atoms in a molecule" means that the cured product may be included not only on the surface of the abutment part but also in the interior of the abutment part, and when a surface layer is formed on the abutment part, the cured product is included in the interior of the abutment part and the surface layer is formed on the abutment part.

If the cured product of an ultraviolet curable composition is included at least in the abutment part of the elastic member, the cured product of an ultraviolet curable composition may be included in a portion other than the abutment part of the elastic member.

<<Ultraviolet Curable Composition>>

The ultraviolet curable composition contains a (meth)acrylate compound having an alicyclic structure having 6 or more carbon atoms in a molecule, and further contains other components if necessary.

—(Meth)Acrylate Compound Having Alicyclic Structure Having 6 or More Carbon Atoms in Molecule—

Since the (meth)acrylate compound having an alicyclic structure having 6 or more carbon atoms in a molecule has a special bulky alicyclic structure in a molecule, a (meth)acrylate compound having a small number of functional groups and a low molecular weight can be used therefor. Therefore, the abutment part of the elastic member is easily impregnated with the (meth)acrylate compound, making it possible to efficiently enhance the hardness of the abutment part. When a surface layer is provided on the abutment part, cracking and peeling of the surface layer can be prevented.

In the (meth)acrylate compound having an alicyclic structure having 6 oar more carbon atoms in a molecule, the number of carbon atoms in the alicyclic structure is preferably 6 to 12 and more preferably 8 to 10. When the number of carbon atoms is less than 6, the hardness of the abutment part may be lower, and when the number of carbon atoms exceeds 12, steric hindrance can be caused.

The (meth)acrylate compound having an alicyclic structure having 6 or more carbon atoms in a molecule preferably has 2 to 6 functional groups, more preferably 2 to 4 functional groups. When the number of functional groups is less than 2, the hardness of the abutment part may be lower, and when the number of functional groups exceeds 6, steric hindrance can be caused.

The (meth)acrylate compound having an alicyclic structure having 6 or more carbon atoms in a molecule preferably has a molecular weight of 500 or less. When the molecular weight exceeds 500, the size of the molecular is larger to thereby hardly impregnate the elastic member with the (meth) acrylate compound, and it may be difficult to increase the hardness.

As the (meth)acrylate compound having an alicyclic structure having 6 or more carbon atoms in a molecule, at least one selected from the group consisting of a (meth)acrylate compound having a tricyclodecane structure and a (meth)acrylate compound having an adamantane structure is preferable from the viewpoint of being capable of compensating for the deficiency in crosslinking point by a special cyclic structure even if having a small number of functional groups.

The (meth)acrylate compound having a tricyclodecane structure is not particularly limited and can be appropriately selected depending on the purpose, and examples thereof include tricyclodecane dimethanol diacrylate and tricyclodecane dimethanol dimethacrylate.

As the (meth)acrylate compound having a tricyclodecane structure, one obtained by appropriate synthesis may be used, or a commercially available product may be used. Examples of the commercially available product include one (product name: A-DCP (produced by Shin-Nakamura Chemical Co., Ltd.)).

The (meth)acrylate compound having an adamantane structure is not particularly limited and can be appropriately selected depending on the purpose, and examples thereof include 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

As the (meth)acrylate compound having an adamantane structure, one obtained by appropriate synthesis may be used, or a commercially available product may be used. Examples of the commercially available product include one (product name: X-DA (produced by Idemitsu Kosan Co., Ltd.)), one (product name: X-A-201 (produced by Idemitsu Kosan Co., Ltd.)), and one (product name: ADTM (produced by Mitsubishi Gas Chemical Company Inc.)).

The content of the (meth)acrylate compound having an alicyclic structure having 6 or more carbon atoms in a molecule is not particularly limited and can be appropriately selected depending on the purpose, but it is preferably 20% by mass to 100% by mass and more preferably 50% by mass to 100% by mass relative to the ultraviolet curable composition. When the content is less than 20% by mass, the increase in hardness by a special cyclic structure may be impaired.

Whether the (meth)acrylate compound having an alicyclic structure having 6 or more carbon atoms in a molecule (a (meth)acrylate compound having a tricyclodecane structure or a (meth)acrylate compound having an adamantane structure is particularly preferable.) is included in the abutment part that abuts the surface of the image bearing member of the elastic member or not can be determined by analysis using, for example, an infrared microscope or liquid chromatography.

The ultraviolet curable composition can contain a (meth) acrylate compound having a molecular weight of 100 to 1,500 other than the (meth)acrylate compound having an alicyclic structure having 6 or more carbon atoms in a molecule.

The (meth)acrylate compound having a molecular weight of 100 to 1,500 is not particularly limited and can be appropriately selected depending on the purpose, and examples thereof include dipentaerythritol hexa(meth)acrylate, pentaerythritol tetra(meth)acrylate, pentaerythritol tri(meth) acrylate, pentaerythritol ethoxy tetra(meth)acrylate, trimethylolpropane tri(meth)acrylate, trimethylolpropane ethoxy tri(meth)acrylate, 1,6-hexanediol di(meth)acrylate, ethoxylated bisphenol A di(meth)acrylate, propoxylated ethoxylated bisphenol A di(meth)acrylate, 1,4-butanediol di(meth) acrylate, 1,5-pentanediol di(meth)acrylate, 1,6-hexanediol di(meth)acrylate, 1,7-heptanediol di(meth)acrylate, 1,8-octanediol di(meth)acrylate, 1,9-nonanediol di(meth)acrylate, 1,10-decanediol di(meth)acrylate, 1,11-undecanediol di(meth)acrylate, 1,18-octadecanediol di(meth)acrylate, glycerinpropoxy tri(meth)acrylate, dipropylene glycol di(meth)acrylate, tripropylene glycol di(meth)acrylate, PO-modified neopentyl glycol di(meth)acrylate, PEG 600 di(meth)acrylate, PEG 400 di(meth)acrylate, PEG 200 di(meth)acrylate, neopentyl glycol/hydroxypivalate di(meth) acrylate, octyl/decyl(meth)acrylate, isobornyl(meth)acrylate, ethoxylated phenyl(meth)acylate, and 9,9-bis[4-(2-(meth)acryloyloxyethoxy)phenyl]fluorene. These may be used singly or in combination of two or more. Among them, a compound having a pentaerythrital triacrylate structure and containing 3 to 6 functional groups is preferable.

Examples of the compound having a pentaerythritol triacrylate structure and containing 3 to 6 functional groups include pentaerythritol triacrylate and dipentaerythritol hexaacrylate.

<<Other Components>>

The other components are not particularly limited and can be appropriately selected depending on the purpose, and examples thereof include a photopolymerization initiator, a polymerization inhibitor, and a diluent.

—Photopolymerization Initiator—

The photopolymerization initiator is not particularly limited and can be appropriately selected depending on the purpose as long as it generates active species such as radicals and cations by optical energy to thereby initiate polymerization, and includes a photo-radical polymerization initiator and a photo-cationic polymerization initiator. Among them, a photo-radical polymerization initiator is particularly preferable.

Examples of the photo-radical polymerization initiator include aromatic ketones, an acylphosphine oxide compound, an aromatic onium salt compound, an organic peroxide, a thio compound (thioxantone compound, thiophenyl group-containing compound, and the like), a hexaarylbiimidazole compound, a ketoxime ester compound, a borate compound, an azinium compound, a metallocene compound, an active ester compound, a compound having a carbon-halogen bond, and an alkylamine compound.

The photo-radical polymerization initiator is not particularly limited and can be appropriately selected depending on the purpose, and examples thereof include acetophenone, acetophenone benzyl ketal, 1-hydroxycylohexyl phenyl ketone, 2,2-dimethoxy-2-phenylacetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler's ketone, benzoin propyl ether, benzoin ethyl ether, benzyl dimethyl ketal, 1-(4-isopropylphenyl)-2-hydroxy-2-methylpropan-1-one, 2-hydroxy-2-methyl-1-phenylpropan-1-one, thioxantone, diethylthioxantone, 2-isopropylthioxantone, 2-chlorothioxantone, 2-methyl-1-[4-(methylthio)phenyl]-2-morpholino-propan-1-one, bis(2,4,6-trimethylbenzoyl)-phenylphosphine oxide, 2,4,6-trimethylbenzoyl-diphenyl-phosphine oxide, 2,4-diethylthioxantone, and bis-(2,6-dimethoxybenzoyl)-2,4,4-trimethylpentyl phosphine oxide. These may be used singly or in combination of two or more.

As the photo-radical polymerization initiator, a commercially available product can be used, and examples of the commercially available product include IRGACURE 651, IRGACURE 184, DAROCUR 1173, IRGACURE 2959, IRGACURE 127, IRGACURE 907, IRGACURE 369, IRGACURE 379, DAROCUR TPO, IRGACURE 819, IRGACURE 784, IRGACURE OXE 01, IRGACURE OXE 02, and IRGACURE 754 (all are produced by Ciba Specialty Chemicals Japan); Speedcure TPO (produced by Lambeon); KAYACURE DETX-S(produced by Nippon Kayaku Co., Ltd.); Lucirin TPO, LR8893, and LR8970 (all are produced by BASF; and Ubecryl P36 (produced by UCB). These may be used singly or in combination of two or more.

The content of the photopolymerization initiator is not particularly limited and can be appropriately selected depending on the purpose, but it is preferably 1% by mass to 20% by mass relative to the ultraviolet curable composition.

—Polymerization Inhibitor—

The polymerization inhibitor is not particularly limited and can be appropriately selected depending on the purpose, and examples thereof include phenol compounds such as p-methoxyphenol, cresol, t-butylcatechol, di-t-butylparacresol, hydroquinone monomethyl ether, α-naphthol, 3,5-di-t-butyl-4-hydroxytoluene, 2,2'-methylenebis(4-methyl-6-t-butylphenol, 2,2-methylenebis(4-ethyl-6-butylphenol) and 4,4'-thiobis(3-methyl-6-t-butylphenol); quinone compounds such as p-benzoquinone, anthraquinone, naphthoquinone, phenanthraquinone, p-xyloquinone, p-toluquinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-di-butylhydroquinone, mono-t-butyl hydroquinone, monomethyl hydroquinone and 2,5-di-t-amyl hydroquinone; amine compounds such as phenyl-f-naphthylamine, p-benzylaminophenol, di-β-naphthylparaphenylenediamine, dibenzylhydroxylamine, phenylhydroxylamine and diethylhydroxylamine nitro compounds such as dinitrobenzene, trinitrotoluene and picric acid; oxime compounds such as quinonedioxime and cyclohexanoneoxime; and sulfur compounds such as phenothiazine. These may be used singly or in combination of two or more.

—Diluent—

The diluent is not particularly limited and can be appropriately selected depending on the purpose, and examples thereof include hydrocarbon-based solvents such as toluene and xylene; ester-based solvents such as ethyl acetate, n-butyl acetate, methyl cellosolve acetate and propylene glycol monomethyl ether acetate; ketone-based solvents such as methyl ethyl ketone, methyl isobutyl ketone, diisobutyl ketone, cyclohexanone and cyclopentanone; ether based solvents such as ethylene glycol monomethyl ether, ethylene glycol monoethyl ether and propylene glycol monomethyl ether; and alcohol-based solvents such as ethanol, propanol, 1-butanol, isopropyl alcohol and isobutyl alcohol. These may be used singly or in combination of two or more.

The method for allowing the abutment part of the elastic member to include the cured product of the ultraviolet curable composition containing the (meth)acrylate compound having an alicyclic structure having 6 or more carbon atoms in a molecule is not particularly limited and can be appropriately selected depending on the purpose, and examples thereof include a method (1) in which the abutment part of the elastic member is impregnated with the ultraviolet curable composition by brush coating, dip coating, or the like, and then irradiated with ultraviolet to be cured, a method (2) in which the abutment part of the elastic member is impregnated with the ultraviolet curable composition by brush coating, dip coating, or the like, then spray-coated with the ultraviolet curable composition to farm a surface layer, and irradiated with ultraviolet to be cured, and a method (3) in which the abutment part of the elastic member is impregnated with the ultraviolet curable composition by brush coating, dip coating, or the like, then irradiated with ultraviolet to be cured, and thereafter spray-coated with the ultraviolet curable composition to form a surface layer. Among them, the method (1) is preferable.

The ultraviolet irradiation condition is not particularly limited and can be appropriately selected depending on the purpose, but the integrated light amount is preferably 500 $mJ/cm^2$ to 5,000 $mJ/cm^2$.

The abutment part of the elastic member is allowed to include the cured product of the ultraviolet curable composition containing the (meth)acrylate compound having an alicyclic structure having 6 or more carbon atoms in a molecule (a (meth)acrylate compound having a tricyclodecane structure or a (meth)acrylate compound having an adamantane structure is particularly preferable.), to thereby increase the hardness of the abutment part of the elastic member, making it possible to suppress exfoliation or deformation of the abutment part. Even when the abutment part is abraded over time and the interior thereof is thus exposed, the impregnation action on the interior can similarly suppress the exfoliation or deformation.

The elastic member of the cleaning blade is not particularly limited and can be appropriately selected depending on the purpose, but the elastic member preferably abuts the surface of the image bearing member at a pressing force of 10 N/m to 100 N/m. When the pressing force is less than 10 N/m, cleaning failure is easily caused due to a toner passing through an abutment portion where the elastic member of the cleaning blade abuts the surface of the image bearing member, and when the pressing force exceeds 100 N/m, the cleaning blade may be exfoliated up due to the increase in friction force of the abutment portion. The pressing force is preferably 10 N/m to 50 N/rm.

The pressing force can be measured using, for example, a measurement apparatus into which a small-sized compression load cell manufactured by Kyowa Electronic Instruments Co., Ltd is incorporated.

The angle between the tangent line on the portion where the elastic member of the cleaning blade abuts the surface of the image bearing member and the end surface of the cleaning blade is not particularly limited and can be appropriately selected depending on the purpose, but it is preferably 6° or more and 85° or less.

When the angle θ is less than 65°, the cleaning blade may be exfoliated up, and when the angle exceeds 85°, cleaning failure may be caused.

<Other Steps and Other Units>

Examples of the other units include a charge-eliminating unit, a recycling unit, and a controlling unit.

Examples of the other steps include a charge-eliminating step, a recycling step, and a controlling step.

—Charge-Eliminating Step and Charge-Eliminating Unit—

The charge-eliminating step is a step of applying a charge-eliminating bias to the image bearing member to perform charge-eliminating, and can be suitably performed by a charge-eliminating unit.

The charge-eliminating unit is not particularly limited and can be appropriately selected from known charge-eliminating devices as long as it can apply a charge-eliminating bias to the image bearing member, and examples thereof suitably include a charge-eliminating lamp.

—Recycling Step and Recycling Unit—

The recycling step is a step of recycling the toner removed in the cleaning step to the developing unit, and can be suitably performed by a recycling unit.

The recycling unit is not particularly limited, and includes a known conveying unit.

—Controlling Step and Controlling Unit—

The controlling step is a step of controlling each of the steps, and can be suitably performed by a controlling unit.

The controlling unit is not particularly limited and can be appropriately selected depending on the purpose as long as it can control the operation of each of the units, and examples thereof include instruments such as a sequencer and a computer.

Hereinafter, an embodiment applied to an electrophotographic printer (hereinafter, simply referred to as printer) that is the image forming apparatus of the present invention will be described.

Figure 2:
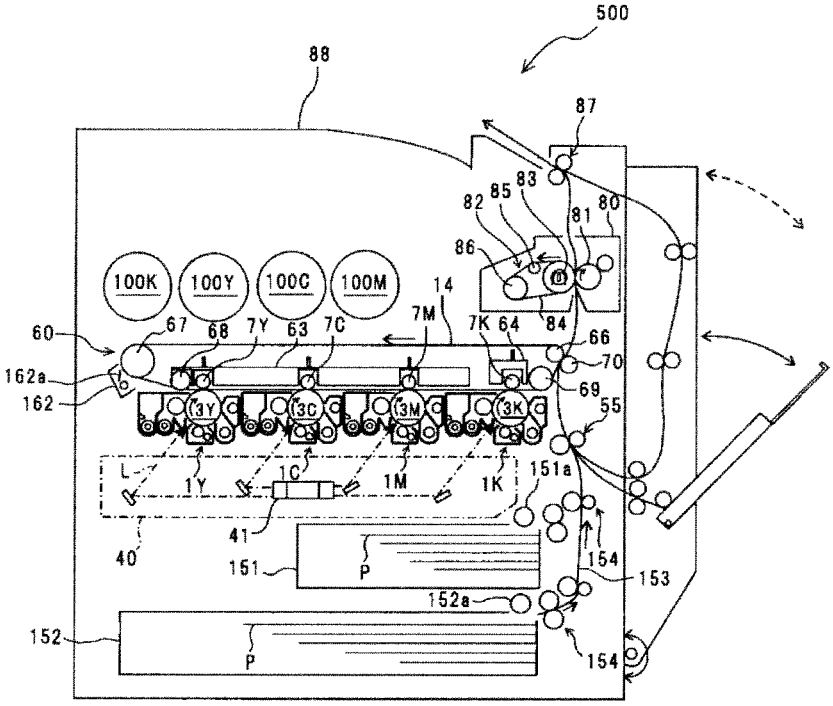
FIG. 2 is a schematic configuration view illustrating one example of an image forming apparatus of the present invention.

FIG. 2 is an entire configuration view schematically illustrating the image forming apparatus 500 of the present invention. Hereinafter, the main part of the image forming apparatus will be described based on the drawing.

The image forming apparatus is provided with four process units 1K, 1C, 1M, and 1Y each having an image creation part for forming an image by a different colored developer, black, cyan, magenta or yellow corresponding to the color separation component of a color image.

The respective process units 1K, 1C, 1M, and 1Y have the same configuration except for accommodating a different colored toner from one another.

The configuration is described by one process unit 1K as an example. The process unit 1K has an image bearing member 2 (photosensitive member), a cleaning unit 3, a charging unit 4, a developing unit 5, a toner storage part 100K, 100Y, 100C and 100M, and the like. The process unit 1K is detachably installed to the main body of the image forming apparatus. As illustrated in FIG. 2, an exposure device 3Y, 3C, 3M, 3K is disposed above each of the process units 1K, 1C, 1M, and 1Y. This exposure device 3Y, 3C, 3M and 3K is configured to emit laser light L from a laser diode 41 based on image data.

A transfer belt apparatus 60 is disposed below each of the process units 1K, 1C, 1M, and 1Y. This transfer belt apparatus 60 is provided with an intermediate transfer belt 12 for transferring a toner image formed on the image bearing member 2. The intermediate transfer belt 12 is configured so as to be suspended over four primary transfer rollers 7Y, 7C, 7M and 7K facing each image bearing member 2, a driving roller 66, a tension roller 67, and a cleaning backup roller 69 to be rotary-driven. A secondary transfer roller 70 is arranged facing the driving roller 66, and a belt cleaning apparatus 14 is disposed facing the cleaning backup roller 69.

The lower part of the image forming apparatus is provided with a paper feeding cassette 151 and 152 capable of accommodating a large number of paper sheets, and a paper feeding roller 151A and 152A that sends a paper sheet from the paper feeding cassette 151 and 152. On the way between the paper feeding roller 151A and 152A and nips of the secondary transfer roller 70 and the driving roller 66, a pair of resistance rollers 81 that temporarily stops a paper sheet is disposed.

A fixing apparatus 80, in which a fixing roller 83, a pressure roller 86, and the like are fixed, is provided above the nips of the secondary transfer roller 70 and the driving roller 66. A pair of paper-ejecting rollers 87 for ejecting a paper sheet P to the exterior is disposed above the fixing apparatus 80. It is configured that a paper sheet ejected by the pair of paper-ejecting rollers 87 is loaded on a paper-ejecting tray 88 formed so that the upper surface of the main body of the image forming apparatus is dented inward.

A waste toner-accommodating device 162 that accommodates waste toner is disposed between the transfer belt apparatus 60 and the paper feeding cassette 151 and 152. A waste toner-transporting hose (not illustrated) extending from the belt cleaning apparatus 14 is connected to an inlet part of the waste toner-accommodating device 162.

Figure 3:
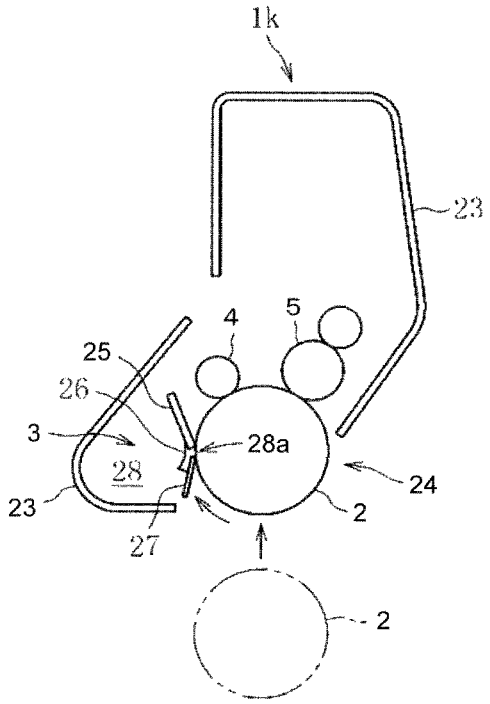
FIG. 3 is a schematic configuration view illustrating a state where a process unit is detached from the main body of the image forming apparatus, or is uninstalled thereon.

FIG. 3 is a schematic configuration view illustrating a state where the process unit 1K is detached from the main body of the image farming apparatus, or is uninstalled thereon. As illustrated in FIG. 3, the process unit has a housing 23. The housing 23 is formed by injection molding of a resin. As the resin, for example, a polycarbonate resin, an acrylonitrile butadiene styrene resin, an acrylonitrile styrene resin, a styrene resin, a polyphenylene ether resin, a polyphenylene oxide resin, a polyether terephthalate resin, or an alloy resin thereof can be applied. The image bearing member 2, the cleaning unit 3, the charging unit 4, the developing unit 5, and the like are disposed in this housing 23.

Then, an image forming operation in the printer will be described.

The printer receives a signal executing printing from an operating part or the like not illustrated in FIG. 2, and then a predetermined voltage or current is sequentially applied to each of a charging apparatus 4 and a developing roller 51 at a predetermined timing. Similarly, a predetermined voltage or current is sequentially applied to each of an exposure apparatus, a charge-eliminating lamp, and the like at a predetermined timing. In synchronization with this, the photosensitive member 2 is rotary-driven in an arrow direction in FIG. 2 by a photosensitive member-driving motor (not illustrated) as a driving unit.

The photosensitive member 2 is rotated in the arrow direction in FIG. 2, and then the surface of the photosensitive member is first charged at a predetermined potential by the charging apparatus 4. Then, the photosensitive member 2 is irradiated with light L corresponding to an image signal from an exposing apparatus not illustrated, and a section of the photosensitive member 2, which is irradiated with light L, is charge-eliminated, and an electrostatic latent image is formed thereon.

The surface of the photosensitive member 2 on which the electrostatic latent image is formed is scraped by a magnetic brush of a developer formed on the developing roller at a part facing the developing apparatus 5. A negatively-charged toner on the developing roller here moves toward the electrostatic latent image by a predetermined developing bias applied to the developing roller, and the electrostatic latent image is formed (developed) into a toner image. In the present embodiment, the electrostatic latent image formed on the photosensitive member 2 is thus reversely developed by the negatively-charged toner by the developing apparatus 5. The present embodiment will be described with reference to an example in which a N/P (negative/positive: toner attaches to a place having a lower potential) non-contact charging roller system is used, but is not limited thereto.

The toner image formed on the photosensitive member 2 is transferred to transfer paper to be subjected to paper feeding, from a paper feeding part not illustrated to a facing part between an upper resistance roller and a lower resistance roller, and then to a transfer region formed between the photosensitive member 2 and the transfer apparatus 12. At this time, the transfer paper is fed in synchronization with the tip end of an image on the facing part between an upper resistance roller and a lower resistance roller. When the toner image is transferred to the transfer paper, a predetermined transfer bias is applied. The transfer paper to which the toner image is transferred is separated from the photosensitive member 2, and conveyed to a fixing apparatus not illustrated, as a fixing unit. Then, by passing through the fixing apparatus, the toner image is fixed on the transfer paper by action of heat and pressure, and the transfer paper is ejected outside the printer.

On the other hand, the surface of the photosensitive member 2 after transfer, from which a residual toner after transfer is removed by the cleaning apparatus 3, is charge-eliminated by a charge-eliminating lamp.

In the present printer, the photosensitive member 2, and the cleaning apparatus 3, the charging apparatus 4, the developing apparatus 5 and the like as process units are accommodated in a flame 23, and they are integrally detachable from the main body of an apparatus as a process cartridge. In the present embodiment, while the photosensitive member 2 as the process cartridge and the process units are configured to be integrally exchanged, a configuration in which each unit of the photosensitive member 2, the cleaning apparatus 3, the charging apparatus 4, and the developing apparatus 5 is exchanged with a new one may be adopted.

As the toner for use in the image forming apparatus, a polymerized toner produced by a suspension polymerization method, an emulsion polymerization method, or a dispersion polymerization method, the toner easily having a higher circularity and a smaller particle diameter, is preferably used from the viewpoint of improvement in image quality. In particular, a polymerized toner having an average circularity of 0.97 or more and a volume average particle diameter of 5.5 μm or less is preferably used from the viewpoint of forming an image having a high resolution.

Figure 1B:
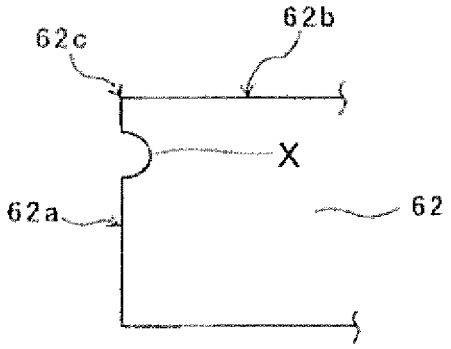
FIG. 1B prior art
FIG. 1B is a view explaining a local abrasion of a tip surface of the conventional cleaning blade.
Figure 1C:
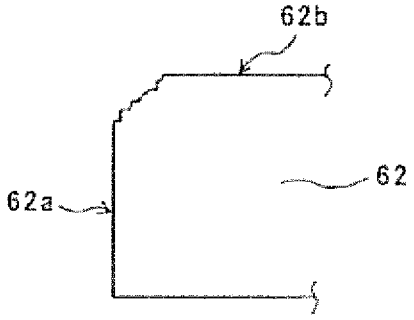
FIG. 1C prior art
FIG. 1C is a view illustrating a state where the abutment part of the conventional cleaning blade is lacked.

The polymerized toner having a high circularity and a small particle diameter is not sufficiently removed from the surface of the photosensitive member 3 to cause cleaning failure even if it is tried to be removed by a cleaning blade 62 as in the case where a conventional pulverized toner is removed from the surface of the photosensitive member 3. Then, if the abutting pressure of the cleaning blade 62 on the photosensitive member 3 is increased to thereby try to increase the cleanability, there is a problem that the cleaning blade 62 is early abraded. In addition, the friction force between the cleaning blade 62 and the photosensitive member 3 is increased, and thus an abutment part (tip ridge line part) 62*c* of the cleaning blade 62 which abuts the photosensitive member 3 is pulled in the moving direction of the photosensitive member 3 to cause the abutment part 62*c* to be exfoliated (see FIG. 1A to FIG. 1C). If the abutment part 62*c* of the cleaning blade 62 is exfoliated, there cause various problems such as abnormal noise, vibration, and the lack of abutment part.

Figure 4:
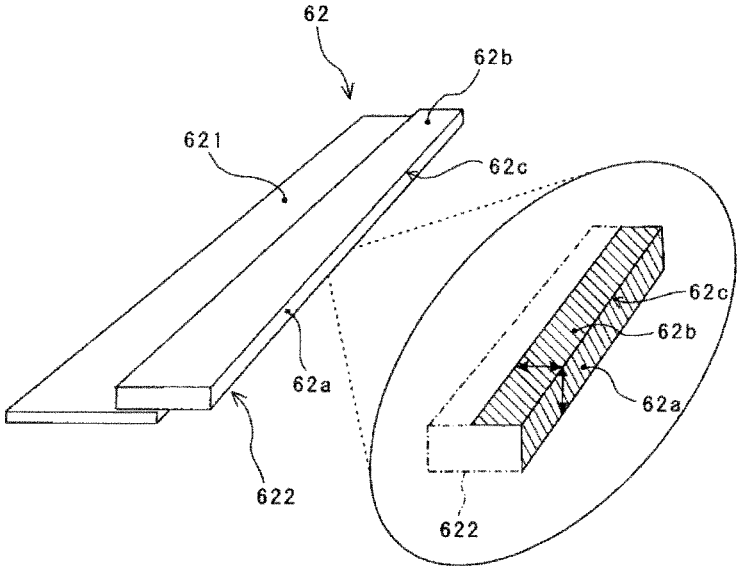
FIG. 4 is a perspective view illustrating one example of a cleaning blade of the present invention.
Figure 5A:
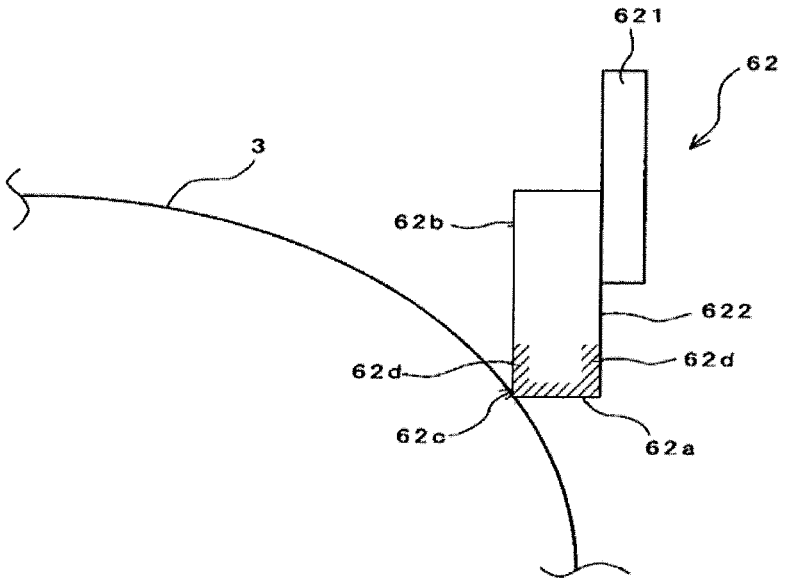
FIG. 5A is an enlarged cross-sectional view illustrating a state where the cleaning blade abuts the surface of an image bearing member.
Figure 5B:
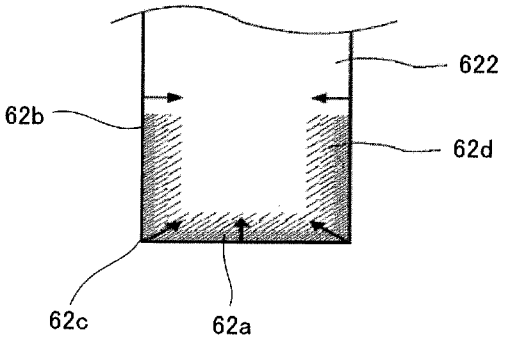
FIG. 5B is an enlarged view of the vicinity of an abutment part of the cleaning blade.

FIG. 4 is a perspective view of the cleaning blade 62, and FIG. 5A and FIG. 5B are each an enlarged cross-sectional view of the cleaning blade 62. FIG. 5A is an illustration diagram of a state where the cleaning blade 62 abuts the surface of the photosensitive member 3, and FIG. 5B is an enlarged illustration diagram of the vicinity of the abutment part (tip ridge line part) 62*c* of the cleaning blade 62.

As illustrated in FIG. 4, the cleaning blade 62 is configured by a plate-shaped supporting member 621 made of a rigid material such as a metal and hard plastic, and a plate-shaped elastic member 622. The elastic member 622 is secured to one end of the supporting member 621 by an adhesive or the like, and the other end of the supporting member 621 is supported by a case for the cleaning apparatus 6 in an open-sided manner.

As illustrated in FIG. 5A, the cleaning blade 62 is composed of the supporting member 621, and the plate-shaped elastic member 622 whose one end is connected to the supporting member and the other end has a free end having a predetermined length, and is arranged so that the abutment part 62*c* which is one end at the free end side of the elastic member 622 abuts the surface of the image bearing member 3 along the longitudinal direction.

The elastic member 622 is preferably one having a high repulsive elastic modulus so as to be able to follow eccentricity of the image bearing member 3, minute waviness on the surface of the image bearing member 3, and the like, and a polyurethane rubber or the like is suitable therefor. The JIS-A hardness of the elastic member is preferably 60 degrees or more. In addition, the repulsive elastic modulus of the elastic member according to JIS K6255 standard is preferably 35% or less at 23° C.

The abutment part 62*c* of the elastic member 622 which abuts the surface of the image bearing member includes a cured product of an ultraviolet curable composition containing a (meth)acrylate compound having an alicyclic structure having 6 or more carbon atoms in a molecule (a (meth) acrylate compound having a tricyclodecane structure or a (meth)acrylate compound having an adamantane structure is particularly preferable.).

The abutment part of the elastic member is impregnated with the ultraviolet curable composition containing a (meth) acrylate compound having an alicyclic structure having 6 or more carbon atoms in a molecule and then irradiated with ultraviolet. Thus, an impregnated portion 62*d* illustrated in FIG. 5B is formed, thereby increasing the hardness of the abutment part 62*c*, achieving the enhancement in durability, and making it possible to suppress deformation of the elastic member in the moving direction of the surface of the image bearing member 3. Even when a surface layer is abraded over time and the interior thereof is thus exposed, the impregnated portion 62*d* can similarly suppress the deformation.

(Process Cartridge)

A process cartridge of the present invention has at least an image bearing member, a charging unit configured to charge a surface of the image bearing member, and a cleaning unit having a cleaning blade configured to remove a toner remaining on the image bearing member, and further has other units if necessary.

As the cleaning unit, the cleaning blade of the present invention is used.

The process cartridge is an apparatus (part) that has an image bearing member and the cleaning blade of the present invention therein, that is further provided with at least one unit of a charging unit, an exposure unit, a developing unit, a transfer unit, a cleaning unit and a charge-eliminating unit, and that is detachable from an image forming apparatus.

EXAMPLES

Hereinafter, Examples of the present invention will be described, but the present invention is not limited to these Examples at all.

<Ten-Point Average Roughness Rz of Charging Roller>

The ten-point average roughness Rz was one measured according to JIS B0601-1994 standard, and was measured using Surfcom 1400D (manufactured by Tokyo Seimitsu Co., Ltd.).

<Pressing Force (Linear Pressure) of Charging Roller>

The pressing force of a charging roller was measured using a measurement apparatus into which a small-sized compression load cell manufactured by Kyowa Electronic Instruments Co., Ltd. was incorporated.

<JIS-A Hardness of Elastic Member>

The JIS-A hardness of an elastic member was measured according to JIS K6253 using a micro rubber hardness meter MD-1 manufactured by Kobunshi Keiki Co., Ltd. With respect to an elastic member of a two-layer structure, measurement was performed from the side of each surface.

<Repulsive Elastic Modulus of Elastic Member>

The repulsive elastic modulus of an elastic member was measured according to JIS K6255 using a resilience tester No. 221 manufactured by Toyo Seiki Seisaku-Sho, Ltd. A measurement sample, in which sheets having a thickness of about 2 mm were stacked so that the thickness of the sample was 4 mm or more, was used.

<Average Circularity of Toner>

Figure 6A:
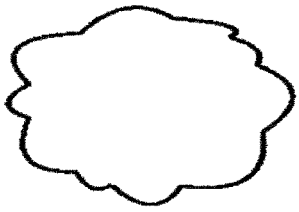
FIG. 6A is an explanation diagram for explaining a method for measuring the average circularity of toner.
Figure 6B:
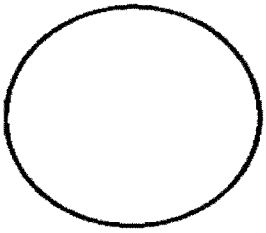
FIG. 6B is an explanation diagram for explaining a method for measuring the average circularity of toner.

The average circularity of toner was measured by a flow-type particle image analyzer (FPIA-2000, manufactured by Sysmex Corporation). Specifically, into 100 mL to 150 mL of water, from which solid impurities in a vessel were removed in advance, was added 0.1 mL to 0.5 mL of a surfactant (alkylbenzene sulfonate) as a dispersant, and was further added about 0.1 g to 0.5 g of a measurement sample (toner). Thereafter, a suspension in which this toner was dispersed was subjected to a dispersing treatment by an ultrasonic dispersing device for 1 minute to 3 minutes so that the concentration in a dispersion liquid was 3,000/μL to 10,000/μL, the suspension was set to the analysis apparatus, and the shape and distribution of the toner were measured. Then, C2/C1 wherein C1 represents the peripheral length of an actually projected shape of toner illustrated in FIG. 6A, S represents the projected area there, and C2 represents the peripheral length of a true circle having the same projected area S was determined based on the measurement results, and the average value of C2/C1 was defined as the average circularity.

<Volume Average Particle Diameter of Toner>

The volume average particle diameter of toner was determined by the Coulter Counter method. Specifically, the date of the number distribution and the volume distribution of toner measured by Coulter Multisizer 2e Type (manufactured by Beckman Coulter Inc.) was sent to a personal computer through an interface (manufactured by Nikkaki-Bios), and analyzed. More specifically, an aqueous 1% by mass NaCl solution using a first grade sodium chloride was prepared as an electrolyte. Then, into 100 mL to 150 mL of this aqueous electrolytic solution was added 0.1 mL to 5 mL of a surfactant (alkylbenzene sulfonate) as a dispersant. Furthermore, 2 mg to 20 mg of a toner as a sample to be tested was added thereto and subjected to a dispersing treatment by an ultrasonic dispersing device for 1 minute to 3 minutes. Then, 100 mL to 200 mL of the aqueous electrolytic solution was placed in another beaker, thereto was added the solution subjected to a dispersing treatment so that a predetermined concentration was achieved, and the resultant was subjected to analysis by the Coulter Multisizer 2e Type.

The particle diameters of 50,000 toner particles were measured using a 100 μm aperture. The following 13 channels: 2.00 μm or more and less than 2.52 μm; 2.52 μm or more and less than 3.17 μm; 3.17 μm or more and less than 4.00 μm; 4.00 μm or more and less than 5.04 μm; 5.04 μm or more and less than 6.35 μm; 6.35 μm or more and less than 8.00 μm; 8.00 μm or more and less than 10.08 μm; 10.08 μm or more and less than 12.70 μm; 12.70 μm or more and less than 16.00 μm; 16.00 μm or more and less than 20.20 μm; 20.20 μm or more and less than 25.40 μm; 25.40 μm or more and less than 32.00 μm; and 32.00 μm or more and less than 40.30 μm were used as channels, and toner particles having a particle diameter of 2.00 μm or more and 32.0 μm or less were measured.

Then, the volume average particle diameter was calculated based on the relational expression "volume average particle diameter=ΣXfV/ΣfV". Herein, "X" represents a representative diameter in each channel, "V" represents a volume corresponding the representative diameter of each channel, and "f" represents the number of particles in each channel.

Production Example 1 of Charging Roller

Preparation of Charging Roller 1

A charging roller was prepared with reference to the method for producing a charging roller described in Japanese Patent Application Laid-Open No. 2011-95725.

The surface of the resulting charging miller was roughened using a lapping film sheet manufactured by 3M to prepare charging roller 1 having a ten-point average roughness Rz of 10 μm.

Production Examples 2 to 5 of Charging Rollers

Preparation of Charging Rollers 2 to 5

Charging rollers 2 to 5 were prepared in the same manner as in Production Example 1 of Charging Roller except that the roughness of a lapping film sheet manufactured by 3M was changed to adjust the ten-point average roughness Rz in Production Example 1 of Charging Roller.

TABLE 1

| | Charging roller | Ten-point average roughness Rz |
|---|---|---|
| Production Example 1 of Charging Roller | Charging roller 1 | 10 μm |
| Production Example 2 of Charging Roller | Charging roller 2 | 2 μm |
| Production Example 3 of Charging Roller | Charging roller 3 | 20 μm |
| Production Example 4 of Charging Roller | Charging roller 4 | 0.5 μm |
| Production Example 5 of Charging Roller | Charging roller 5 | 25 μm |

Production Example 1 of Elastic Member

Preparation of Elastic Member 1

Plate-shaped elastic member 1 having an average thickness of 1.8 mm and a size of 11.5 mm×32.6 mm was prepared with reference to the method for producing a cleaning blade described in Example 1 in Japanese Patent Application Laid-Open No. 2011-141449.

In the resulting elastic member 1, the JIS-A hardness was 68 degrees, and the repulsive elastic modulus was 30%.

Production Example 2 of Elastic Member

Preparation of Elastic Member 2

Plate-shaped elastic member 2 of a two-layer structure, having an average thickness of 1.8 mm and a size of 11.5 mm×32.6 mm, was prepared with reference to the method for producing a cleaning blade described in Examples 2 in Japanese Patent Application Laid-Open No. 2011-141449.

In the resulting elastic member 2 of a two-layer structure, the JIS-A hardness on the abutment surface was 80 degrees, the JIBS-A hardness on the rear abutment surface was 75 degrees, and the repulsive elastic modulus was 25%.

Preparation Example 1

Preparation of Ultraviolet Curable Composition 1

Ultraviolet curable composition 1 was prepared from the following composition by an ordinary method.

| | |
|---|---|
| Tricyclodecane dimethanol diacrylate represented by the following structural formula (produced by Shin-Nakamura Chemical Co., Ltd., product name: A-DCP, number of functional groups: 2, molecular weight: 304) | 50 parts by mass |
| 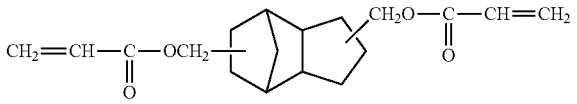 | |
| Polymerization initiator (produced by Ciba Specialty Chemicals Japan, IRGACURE 184) | 5 parts by mass |
| Solvent (cyclohexanone) | 55 parts by mass |

Preparation Example 2

Preparation of Ultraviolet Curable Composition 2

Ultraviolet curable composition 2 was prepared from the following composition by an ordinary method.

| | |
|---|---|
| (Meth)acrylate compound 1 having an adamantane structure represented by the following structural formula (produced by Idemitsu Kosan Co., Ltd., X-DA, number of functional groups: 2, molecular weight: 276 to 304, reaction product of 1,3-adamantanediol and acrylic acid) | 50 parts by mass |
| 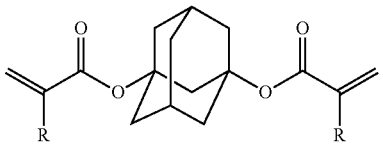 | |
| (wherein R represents a hydrogen atom or a methyl group). | |
| Polymerization initiator (produced by Ciba Specialty Chemicals Japan, IRGACURE 184) | 5 parts by mass |
| Solvent (cyclohexanone) | 55 parts by mass |

Preparation Example 3

Preparation of Ultraviolet Curable Composition 3

Ultraviolet curable composition 3 was prepared from the following composition by an ordinary method.

| | |
|---|---|
| (Meth)acrylate compound 2 having an adamantane structure represented by the following structural formula (1,3-adamantane dimethanol diacrylate, produced by Idemitsu Kosan Co., Ltd., X-A-201, number of functional groups: 2, molecular weight: 304) | 50 parts by mass |

-continued

| | |
|---|---|
| 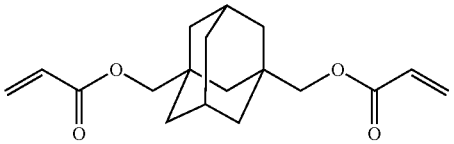 | |
| Polymerization initiator (produced by Ciba Specialty Chemicals Japan, IRGACURE 184) | 5 parts by mass |
| Solvent (cyclohexanone) | 55 parts by mass |

Preparation Example 4

Preparation of Ultraviolet Curable Composition 4

Ultraviolet curable composition 4 was prepared from the following composition by an ordinary method.

| | |
|---|---|
| (Meth)acrylate compound 3 having an adamantane structure represented by the following structural formula (produced by Mitsubishi Gas Chemical Company Inc., Diapurest ADTM, number of functional groups: 3, molecular weight: 388) | 50 parts by mass |
| 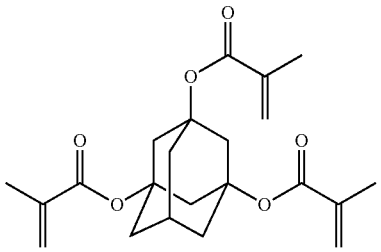 | |
| Polymerization initiator (produced by Ciba Specialty Chemicals Japan, IRGACURE 184) | 5 parts by mass |
| Solvent (cyclohexanone) | 55 parts by mass |

Preparation Example 5

Preparation of Ultraviolet Curable Composition 5

Ultraviolet curable composition 5 was prepared from the following composition by an ordinary method.

| | |
|---|---|
| Tricyclodecane dimethanol diacrylate represented by the structural formula (produced by Shin-Nakamura Chemical Co., Ltd., A-DCP, number of functional groups: 2, molecular weight: 304) | 25 parts by mass |
| Pentaerythritol triacrylate represented by the following structural formula (produced by Daicel Cytec Co., Ltd., PETIA, number of functional groups: 3, molecular weight: 298) | 25 parts by mass |
| 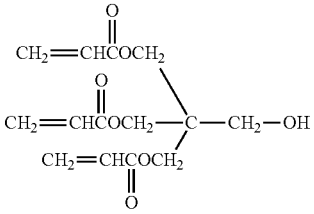 | |

-continued

| | |
|---|---|
| Polymerization initiator (produced by Ciba Specialty Chemicals Japan, IRGACURE 184) | 5 parts by mass |
| Solvent (cyclohexanone) | 55 parts by mass |

Preparation Example 6

Preparation of Ultraviolet Curable Composition 6

Ultraviolet curable composition 6 was prepared from the following composition by an ordinary method.

| | |
|---|---|
| (Meth)acrylate compound 2 having an adamantane structure represented by the structural formula (1,3-adamantane dimethanol diacrylate, produced by Idemitsu Kosan Co., Ltd., X-A-201, number of functional groups: 2, molecular weight: 304) | 25 parts by mass |
| Pentaerythritol triacrylate represented by the structural formula (produced by Daicel Cytec Co., Ltd., PETIA, number of functional groups: 3, molecular weight: 298) | 25 parts by mass |
| Polymerization initiator (produced by Ciba Specialty Chemicals Japan, IRGACURE 184) | 5 parts by mass |
| Solvent (cyclohexanone) | 55 parts by mass |

Preparation Example 7

Preparation of Ultraviolet Curable Composition 7

Ultraviolet curable composition 7 was prepared from the following composition by an ordinary method.

| | |
|---|---|
| Pentaerythritol triacrylate represented by the structural formula (produced by Daicel Cytec Co., Ltd., PETIA, number of functional groups: 3, molecular weight: 298) | 50 parts by mass |
| Polymerization initiator (produced by Ciba Specialty Chemicals Japan, IRGACURE 184) | 5 parts by mass |
| Solvent (cyclohexanone) | 55 parts by mass |

Preparation Example 8

Preparation of Ultraviolet Curable Composition 8

Ultraviolet curable composition 8 was prepared from the following composition by an ordinary method.

| | |
|---|---|
| Dipentaerythritol hexaacrylate represented by the following structural formula (produced by Daicel Cytec Co., Ltd., DPHA, number of functional groups: 6, molecular weight: 578) | 59 parts by mass |

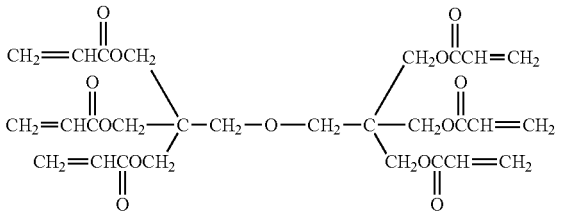

| | |
|---|---|
| Polymerization initiator (produced by Ciba Specialty Chemicals Japan, IRGACURE 184) | 5 parts by mass |
| Solvent (cyclohexanone) | 55 parts by mass |

<Production Example of Toner>

Toner base particles having an average circularity of 0.98 and a volume average particle diameter of 4.9 μm were prepared by a polymerization method. Based on 100 parts by mass of the resulting toner base particles, 1.5 parts by mass of silica fine particles having a small particle diameter (produced by Clariant, H2000), 0.5 parts by mass of titanium oxide fine particles having a small particle diameter (produced by Tayca, MT-150AI), and silica fine particles having a large particle diameter (produced by Denki Kagaku Kogyo K. K. UFP-30H) were stirred and mixed by a Henschel mixer, to prepare a toner.

Production Example 1 of Cleaning Blade

Preparation of Cleaning Blade 1

A part from the tip abutting the image bearing member, of the elastic member 1, to a position of 2 mm was immersed in a liquid, in which the ultraviolet curable composition 1 was diluted with a diluent (cyclohexanone) so that the concentration of the solid content was 50% by mass, for 2 hours, and air-dried for 3 minutes. After the air-drying, the resultant was irradiated with ultraviolet (140 W/cm×5 m/min×5 passes) using an ultraviolet irradiation apparatus (manufactured by Ushio Inc., UVC-25.34/1MNLC3). Then, drying was performed using a thermal dryer at a dryer temperature of 100° C. for 15 minutes.

Then, elastic member 1 subjected to a surface-curing treatment was secured to a plate holder as a supporting member by an adhesive to prepare cleaning blade 1.

Production Examples 2 to 6 of Cleaning Blades, and Comparative Production Examples 1 to 2 of Cleaning Blades Preparation of Cleaning Blades 2 to 6 and 9 to 10

Each of cleaning blades 2 to 6 in Production Examples 2 to 6 of Cleaning Blades and cleaning blades 9 to 10 in Comparative Production Examples 1 to 2 of Cleaning Blades was prepared in the same manner as in Production Example 1 of Cleaning Blade except for changing to each ultraviolet curable composition shown in Table 3 in Production Example 1 of Cleaning Blade.

Production Examples 7 to 8 of Cleaning Blades

Preparation of Cleaning Blades 7 to 8

Each of cleaning blades 7 to 8 in Production Examples 7 to 8 of Cleaning Blades was prepared in the same manner as in Production Example 1 of Cleaning Blade except for changing to elastic member 2 shown in Table 2 and to each ultraviolet curable composition shown in Table 3 in Production Example 1 of Cleaning Blade. Herein, the elastic member of a two-layer structure was one obtained by pasting two rubbers having different physical properties as described above, and the rubber of the contact part (abutment part, tip ridge line part) with the image bearing member was a rubber having a higher hardness.

TABLE 2

| | | Elastic member | | | |
|---|---|---|---|---|---|
| | Cleaning blade No. | No. | Structure | JIS-A hardness | Repulsive elastic modulus |
| Production Example 1 | Cleaning blade 1 | 1 | Single layer | 68 degrees | 30% |
| Production Example 2 | Cleaning blade 2 | 1 | Single layer | 68 degrees | 30% |
| Production Example 3 | Cleaning blade 3 | 1 | Single layer | 68 degrees | 30% |
| Production Example 4 | Cleaning blade 4 | 1 | Single layer | 68 degrees | 30% |
| Production Example 5 | Cleaning blade 5 | 1 | Single layer | 68 degrees | 30% |
| Production Example 6 | Cleaning blade 6 | 1 | Single layer | 68 degrees | 30% |
| Production Example 7 | Cleaning blade 7 | 2 | Two-layer | 80 degrees + 75 degrees | 25% |
| Production Example 8 | Cleaning blade 8 | 2 | Two-layer | 80 degrees + 75 degrees | 25% |
| Comparative Production Example 1 | Cleaning blade 9 | 1 | Single layer | 68 degrees | 30% |
| Comparative Production Example 2 | Cleaning blade 10 | 1 | Single layer | 68 degrees | 30% |

TABLE 3

| | Ultraviolet curable composition | | | | |
|---|---|---|---|---|---|
| | No. | Polymerizable monomer 1 | Polymerizable monomer 2 | Polymerization initiator | Solvent |
| Production Example 1 | 1 | Tricyclodecane dimethanol diacrylate | — | IRGACURE 184 | Cyclohexanone |
| Production Example 2 | 2 | (Meth)acrylate compound 1 having adamantane structure | — | IRGACURE 184 | Cyclohexanone |
| Production Example 3 | 3 | (Meth)acrylate compound 2 having adamantane structure | — | IRGACURE 184 | Cyclohexanone |
| Production Example 4 | 4 | (Meth)acrylate compound 3 having adamantane structure | — | IRGACURE 184 | Cyclohexanone |
| Production Example 5 | 5 | Tricyclodecane dimethanol diacrylate | Pentaerythritol triacrylate | IRGACURE 184 | Cyclohexanone |
| Production Example 6 | 6 | (Meth)acrylate compound 2 having adamantane structure | Pentaerythritol triacrylate | IRGACURE 184 | Cyclohexanone |
| Production Example 7 | 1 | Tricyclodecane dimethanol diacrylate | — | IRGACURE 184 | Cyclohexanone |
| Production Example 8 | 2 | (Meth)acrylate compound 1 having adamantane structure | — | IRGACURE 184 | Cyclohexanone |
| Comparative Production Example 1 | | | None | | |
| Comparative Production Example 2 | 7 | Pentaerythritol triacrylate | — | IRGACURE 184 | Cyclohexanone |

Example 1

Charging roller 1 prepared was mounted to a color multifunction peripheral (imagio MP C5001, manufactured by Ricoh Company, Ltd.) so as to abut the peripheral at a pressing force (linear pressure 200 mN/cm), and cleaning blade 1 prepared was mounted to a color multifunction peripheral (imagio MP C5001, manufactured by Ricoh Company, Ltd.) at a predetermined tip penetration amount (pressing force) and a predetermined mounting angle. Herein, the linear pressure and mounting angle of the cleaning blade varied depending on the sample type of the cleaning blade. A wetting agent-applying unit of an image bearing member mounted as standard was removed.

The toner prepared was loaded on the color multifunction peripheral (imagio MP C5001, manufactured by Ricoh Company, Ltd.) altered, an image of a chart (A4 size landscape) having an image area rate of 5%, to which a band was partially added, was output for 30,000 sheets with 2 prints/job under an environment of 23° C. and 50% RH, and the charging unevenness, and the contamination of the charging roller were evaluated as follows. The results were shown in Table 4-1.

The exfoliation amount and cleanability of the abutment part, and the abrasion amount of the abutment part were evaluated as follows. The results were shown in 4-2.

<Charging Unevenness>

A 1 by 1 pattern was output at the initial time and after outputting for 30,000 sheets, and the image unevenness due to charging was visually observed, and the charging unevenness was evaluated.

<Contamination of Charging Roller>

The contamination of the charging roller was visually observed at the initial time and after outputting for 30.000 sheets, and evaluated.

<Exfoliation Amount of Abutment Part>

When a glass plate to which a material for use in the surface layer of the photosensitive member was applied was scraped by the cleaning blade at the predetermined end penetration amount (linear pressure) and mounting angle, a state of the cleaning blade abutting the glass plate was observed from the backside of the glass plate, and the exfoliation length on the abutment part of the elastic member of the cleaning blade was determined using an image output by a CCD camera (Nikon CM-5, manufactured by Nicon Corporation).

<Cleanability>

After the outputting for 30,000 sheets, an image output after an image for evaluation of a chart having three vertical band patterns (relative to paper traveling direction) having a width of 43 mm was output for 20 sheets (A4 size landscape) was visually observed, and the cleanability was evaluated according to the following criteria. Herein, the abnormal image means a linear or band-shaped image appearing in a printing image, or a white spot image.

[Evaluation Criteria]

Good: No abnormal image was observed.

Bad: Abnormal image was observed.

<Abrasion Amount of Abutment Part>

Figure 7:
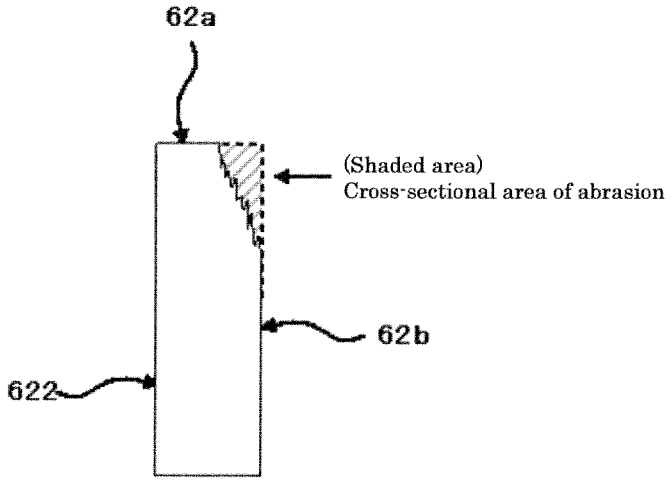
FIG. 7 is a diagram for explaining a method for measuring the amount of abrasion of a cleaning blade in Example.

After the outputting for 30,000 sheets, the abrasion amount of the abutment part of the elastic member was determined by measuring the abrasion width observed from the tip surface of the elastic member as illustrated in FIG. 7 by a laser microscope VK-9510 manufactured by Keyence Corporation.

Examples 2 to 15 and Comparative Examples 1, 2, 4 and 5

Each image forming apparatus was assembled in the same manner as in Example 1 except that at least any of the charging roller number, the pressing force (linear pressure) of the charging roller, and the cleaning blade number in Example 1 was changed as shown in Table 4-1 and evaluated in the same manner as in Example 1. The results were shown in Table 4-1 and Table 4-2.

TABLE 4-1

| | Cleaning blade No. | Charging roller No. | Pressing force of charging roller (mN/cm) | Charging unevenness: Initial | Charging unevenness: After outputting for 30,000 sheets | Contamination of charging roller |
|---|---|---|---|---|---|---|
| Ex. 1 | 1 | 1 | 200 | Suppressed | Suppressed | No contamination |
| Ex. 2 | 1 | 1 | 600 | Suppressed | Suppressed | No contamination |
| Ex. 3 | 1 | 1 | 1000 | Suppressed | Suppressed | No contamination |
| Ex. 4 | 1 | 1 | 10 | Suppressed | Suppressed | No contamination |
| Ex. 5 | 1 | 2 | 600 | Suppressed | Suppressed | No contamination |
| Ex. 6 | 1 | 3 | 600 | Suppressed | Suppressed | No contamination |
| Ex. 7 | 2 | 1 | 600 | Suppressed | Suppressed | No contamination |
| Ex. 8 | 3 | 1 | 600 | Suppressed | Suppressed | No contamination |
| Ex. 9 | 4 | 1 | 600 | Suppressed | Suppressed | No contamination |
| Ex. 10 | 5 | 1 | 600 | Suppressed | Suppressed | No contamination |
| Ex. 11 | 6 | 1 | 600 | Suppressed | Suppressed | No contamination |
| Ex. 12 | 7 | 1 | 600 | Suppressed | Suppressed | No contamination |
| Ex. 13 | 8 | 1 | 600 | Suppressed | Suppressed | No contamination |
| Ex. 14 | 1 | 4 | 600 | Slight lateral line | Slight lateral line | No contamination |
| Ex. 15 | 1 | 5 | 600 | Slight density unevenness | Slight density unevenness | No contamination |
| Comp. Ex. 1 | 9 | 1 | 600 | Suppressed | Vertical line corresponding to contamination | Contamination |
| Comp. Ex. 2 | 9 | 1 | 1000 | Suppressed | Vertical line corresponding to contamination | Contamination |
| Comp. Ex. 4 | 10 | 1 | 600 | Suppressed | Vertical line corresponding to contamination | Contamination |
| Comp. Ex. 5 | 11 | 1 | 600 | Suppressed | Vertical line corresponding to contamination | Contamination |

TABLE 4-2

| | Cleaning blade No. | Charging roller No. | Clean-ability | Exfoliation amount (μm) | Abrasion amount (μm) |
|---|---|---|---|---|---|
| Ex. 1 | 1 | 1 | Good | 0 | 4 |
| Ex. 2 | 1 | 1 | Good | 0 | 4 |
| Ex. 3 | 1 | 1 | Good | 0 | 4 |
| Ex. 4 | 1 | 1 | Good | 0 | 4 |
| Ex. 5 | 1 | 2 | Good | 0 | 4 |
| Ex. 6 | 1 | 3 | Good | 0 | 4 |
| Ex. 7 | 2 | 1 | Good | 0 | 8 |
| Ex. 8 | 3 | 1 | Good | 0 | 3 |
| Ex. 9 | 4 | 1 | Good | 0 | 3 |
| Ex. 10 | 5 | 1 | Good | 0 | 4 |

TABLE 4-2-continued

| | Cleaning blade No. | Charging roller No. | Clean-ability | Exfoliation amount (μm) | Abrasion amount (μm) |
|---|---|---|---|---|---|
| Ex. 11 | 6 | 1 | Good | 0 | 4 |
| Ex. 12 | 7 | 1 | Good | 0 | 4 |
| Ex. 13 | 8 | 1 | Good | 0 | 4 |
| Ex. 14 | 1 | 4 | Good | 0 | 4 |
| Ex. 15 | 1 | 5 | Good | 0 | 4 |
| Comp. Ex. 1 | 9 | 1 | Bad | 10 | Unmeasurable |
| Comp. Ex. 2 | 9 | 1 | Bad | 10 | Unmeasurable |
| Comp. Ex. 4 | 10 | 1 | Bad | 4 | Unmeasurable |
| Comp. Ex. 5 | 11 | 1 | Bad | 6 | Unmeasurable |

Aspects of the present invention are, for example, as follows.

<1> An image forming apparatus, including:

an image bearing member;

a charging unit configured to charge a surface of the image bearing member;

an exposure unit configured to expose the charged surface of the image bearing member to light, to thereby form an electrostatic latent image;

a developing unit configured to develop the electrostatic latent image with a toner to form a visible image;

a transfer unit configured to transfer the visible image to a recording medium;

a fixing unit configured to fix the transferred visible image on the recording medium; and a cleaning unit including a cleaning blade configured to remove the toner remaining on the image bearing member, wherein the charging unit includes a charging roller that is brought into contact with the image bearing member for charging, the charging roller abutting the image bearing member at a pressing force of 10 mN/cm to 1,000 mN/cm, wherein the cleaning blade includes an elastic member that abuts the surface of the image bearing member to remove a residue attached to the surface of the image bearing member, and wherein an abutment part of the elastic member, which abuts the surface of the image bearing member, includes a cured product of an ultraviolet curable composition containing a (meth)acrylate compound having an alicyclic structure having 6 or more carbon atoms in a molecule.

<2> The image forming apparatus according to <1>, wherein the charging roller has a ten-point average roughness Rz of 2 μm to 20 μm.

<3> The image farming apparatus according to <1> or <2>, wherein the (meth)acrylate compound having an alicyclic structure having 6 or more carbon atoms in a molecule contains 2 to 6 functional groups.

<4> The image forming apparatus according to any one of <1> to <3>, wherein the (meth)acrylate compound having an alicyclic structure having 6 or more carbon atoms in a molecule has a molecular weight of 500 or less.

<5> The image forming apparatus according to any one of <1> to <4>, wherein the (meth)acrylate compound having an alicyclic structure having 6 or more carbon atoms in a molecule is at least one selected from the group consisting of a (meth) acrylate compound having a tricyclodecane structure and a (meth)acrylate compound having an adamantane structure.

<6> The image forming apparatus according to <5>, wherein the (meth)acrylate compound having a tricyclodecane structure is at least one selected from the group consisting of the group consisting of tricyclodecane dimethanol diacrylate and tricyclodecane dimethanol dimethacrylate.

<7> The image forming apparatus according to <5>, wherein the (meth)acrylate compound having an adamantane structure is at least one selected from the group consisting of 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

<8> The image forming apparatus according to any one of <1> to <7>, wherein the ultraviolet curable composition further includes a (meth)acrylate compound having a pentaerythritol tri (meth)acrylate structure and containing 3 to 6 functional groups.

<9> The image forming apparatus according to any one of <1> to <8>, wherein the elastic member is a laminate obtained by integrally molding two or more rubbers having different JIS-A hardnesses.

<10> The image forming apparatus according to any one of <1> to <9>, wherein the charging unit is a direct voltage charging system, or a system in which direct and alternating voltages are simultaneously applied.

<11> The image forming apparatus according to any one of <1> to <10>, wherein no lubricant is provided on the surface of the image bearing member.

<12> The image forming apparatus according to any one of <1> to <11>, wherein the toner has a volume average particle diameter of 5.5 μm or less and an average circularity of 0.97 or more.

<13> A process cartridge, including:

an image bearing member;

a charging unit configured to charge a surface of the image bearing member; and a cleaning unit including a cleaning blade configured to remove a toner remaining on the image bearing member, wherein the charging unit includes a charging roller that is brought into contact with the image bearing member for charging, the charging roller abutting the image bearing member at a pressing force of 10 mN/cm to 1,000 mN/cm, wherein the cleaning blade has an elastic member that abuts the surface of the image bearing member to remove a residue attached to the surface of the image bearing member, and wherein an abutment part of the elastic member, which abuts the surface of the image bearing member, includes a cured product of an ultraviolet curable composition containing a (meth)acrylate compound having an alicylic structure having 6 or more carbon atoms in a molecule.

<14> An image forming method, including:

charging a surface of an image bearing member;

exposing the charged surface of the image bearing member to light, to thereby form an electrostatic latent image;

developing the electrostatic latent image with a toner to form a visible image;

transferring the visible image to a recording medium;

fixing the transferred visible image on the recording medium;

removing the toner remaining on the image bearing member by a cleaning blade, wherein the charging is performed by a charging unit, and the charging unit includes a charging roller that is brought into contact with the image bearing member for charging, the charging roller abutting the image bearing member at a pressing force of 10 mN/cm to 1,000 mN/cm, wherein the cleaning blade includes an elastic member that abuts the surface of the image bearing member to remove a residue attached to the surface of the image bearing member, and wherein an abutment part of the elastic member, which abuts the surface of the image bearing member, includes a cured product of an ultraviolet curable composition containing a (meth)acrylate compound having an alicyclic structure having 6 or more carbon atoms in a molecule.

This application claims priority to Japanese application No. 2012-282844, filed on Dec. 26, 2012 and Japanese application No. 2013-210055, filed on Oct. 7, 2013, and incorporated herein by reference.

What is claimed is:

1. A cleaning blade, comprising:

an elastic member having an abutment part, wherein the abutment part of the elastic member includes a cured product of an ultraviolet curable composition containing a (meth)acrylate compound having an alicyclic structure having 6 or more carbon atoms in a molecule, and the (meth)acrylate compound having an alicyclic structure having 6 or more carbon atoms in a molecule contains 2 to 6 functional groups.

2. The cleaning blade according to claim 1, further comprising:

a supporting member, wherein one end of the elastic member is connected to the supporting member and other end is a free end, and wherein the abutment part of the elastic member is disposed at the free end of the elastic member.

3. The cleaning blade according to claim 1, wherein the (meth)acrylate compound having an alicyclic structure having 6 or more carbon atoms in a molecule has a molecular weight of 500 or less.

4. The cleaning blade according to claim 1, wherein the (meth)acrylate compound having an alicyclic structure having 6 or more carbon atoms in a molecule is at least one selected from the group consisting of a (meth)acrylate compound having a tricyclodecane structure and a (meth)acrylate compound having an adamantane structure.

5. The cleaning blade according to claim 4, wherein the (meth)acrylate compound having a tricyclodecane structure is at least one selected from the group consisting of the group consisting of tricyclodecane dimethanol diacrylate and tricyclodecane dimethanol dimethacrylate.

6. The cleaning blade according to claim 4, wherein the (meth)acrylate compound having an adamantane structure is at least one selected from the group consisting of 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

7. An image forming apparatus, comprising:

an image bearing member;

a charging unit configured to charge a surface of the image bearing member;

an exposure unit configured to expose the charged surface of the image bearing member to light, to thereby form an electrostatic latent image;

a developing unit configured to develop the electrostatic latent image with a toner to form a visible image;

a transfer unit configured to transfer the visible image to a recording medium;

a fixing unit configured to fix the transferred visible image on the recording medium; and a cleaning unit configured to remove the toner remaining on the image bearing member, wherein the cleaning unit is the cleaning blade according to claim 1.

8. The image forming apparatus according to claim 7, wherein the charging unit comprises a charging roller that is brought into contact with the image bearing member for charging, the charging roller abutting the image bearing member at a pressing force of 10 mN/cm to 1,000 mN/cm.

9. A process cartridge, comprising:

an image bearing member;

a charging unit configured to charge a surface of the image bearing member; and a cleaning unit including a cleaning blade configured to remove a toner remaining on the image bearing member, wherein the cleaning unit is the cleaning blade according to claim 1.

10. An image forming method, comprising:

charging a surface of an image bearing member;

exposing the charged surface of the image bearing member to light, to thereby form an electrostatic latent image;

developing the electrostatic latent image with a toner to form a visible image;

transferring the visible image to a recording medium;

fixing the transferred visible image on the recording medium;

removing the toner remaining on the image bearing member by a cleaning blade, wherein the cleaning blade is the cleaning blade according to claim 1.

* * * * *

UNITED STATES PATENT AND TRADEMARK OFFICE

CERTIFICATE OF CORRECTION

PATENT NO. : 9,052,631 B2
APPLICATION NO. : 14/132444
DATED : June 9, 2015
INVENTOR(S) : Gohda et al.

It is certified that error appears in the above-identified patent and that said Letters Patent is hereby corrected as shown below:

On the title page insert item [30],

-- (30) Foreign Application Priority Data:
Dec. 26, 2012 (JP) 2012-282844;
Oct. 7, 2013 (JP) 2013-210055 --.

Signed and Sealed this
Twenty-third Day of February, 2016

Michelle K. Lee

Michelle K. Lee
*Director of the United States Patent and Trademark Office*